US007178799B2

(12) United States Patent
Wakabayashi et al.

(10) Patent No.: US 7,178,799 B2
(45) Date of Patent: Feb. 20, 2007

(54) POST PROCESSING DEVICE WITH SADDLE SUPPORT

(75) Inventors: Hiroyuki Wakabayashi, Hachioji (JP); Toshio Shida, Higashiyamato (JP); Masaaki Uchiyama, Hachioji (JP); Masato Hattori, Hino (JP); Kenji Kawatsu, Machida (JP)

(73) Assignee: Konica Minolta Business Technologies, Inc. (JP)

( * ) Notice: Subject to any disclaimer, the term of this patent is extended or adjusted under 35 U.S.C. 154(b) by 228 days.

(21) Appl. No.: 10/851,890

(22) Filed: May 21, 2004

(65) Prior Publication Data

US 2005/0062208 A1 Mar. 24, 2005

(30) Foreign Application Priority Data

Sep. 8, 2003 (JP) ..... 2003-315075
Sep. 11, 2003 (JP) ..... 2003-319510

(51) Int. Cl.
*B41L 1/32* (2006.01)

(52) U.S. Cl. ..... 270/39.06; 270/39.07; 270/39.08; 270/37; 270/58.07

(58) Field of Classification Search ..... 270/580.7, 270/52.17, 52.18, 32, 37, 39.06, 39.07, 39.08, 270/58.07; 83/934
See application file for complete search history.

(56) References Cited

U.S. PATENT DOCUMENTS 4,592,651 A * 6/1986 Oikawa et al. ..... 355/72
5,086,681 A * 2/1992 Ruetschle et al. ..... 83/277
5,377,965 A * 1/1995 Mandel et al. ..... 270/37
6,363,851 B1 * 4/2002 Gerhard et al. ..... 101/483
6,550,756 B2 * 4/2003 Trovinger ..... 270/52.26
6,554,267 B2 * 4/2003 Trovinger ..... 270/52.18
6,578,838 B2 * 6/2003 Trovinger et al. ..... 270/52.18
6,929,256 B2 * 8/2005 Kawatsu et al. ..... 270/37
6,981,830 B2 * 1/2006 Trovinger ..... 412/33
6,991,224 B2 * 1/2006 Trovinger et al. ..... 270/32

FOREIGN PATENT DOCUMENTS

| | | |
|---|---|---|
| JP | 2516010 | 8/1996 |
| JP | 10-35135 | 2/1998 |
| JP | 2000211806 A * | 8/2000 |
| JP | 2001-151406 | 6/2001 |
| JP | 2003-182928 | 7/2003 |
| WO | WO 200018583 A1 * | 4/2000 |

* cited by examiner

*Primary Examiner*—Douglas Hess
(74) *Attorney, Agent, or Firm*—Cantor Colburn LLP

(57) ABSTRACT

An objective of the present invention is to provide a post processing apparatus to load a center-folded sheet on a loading member and unload the paper sheets when a number of sheet reaches a predetermined number without damages with sheets. A Post-processing apparatus having a center folding member for making a center folded sheet by forming a folded line on a paper sheet, on which image is formed, a loading member for loading a member of center folded sheets by supporting a valley side of the center folded sheets, a supporting member for supporting a folded part or an adjacent folded part of a valley side of the center folded sheets loaded on the loading member, and a driving-means for moving the center folded sheets loaded on the loading member by moving the supporting member.

22 Claims, 33 Drawing Sheets

FIG. 18 ( a )
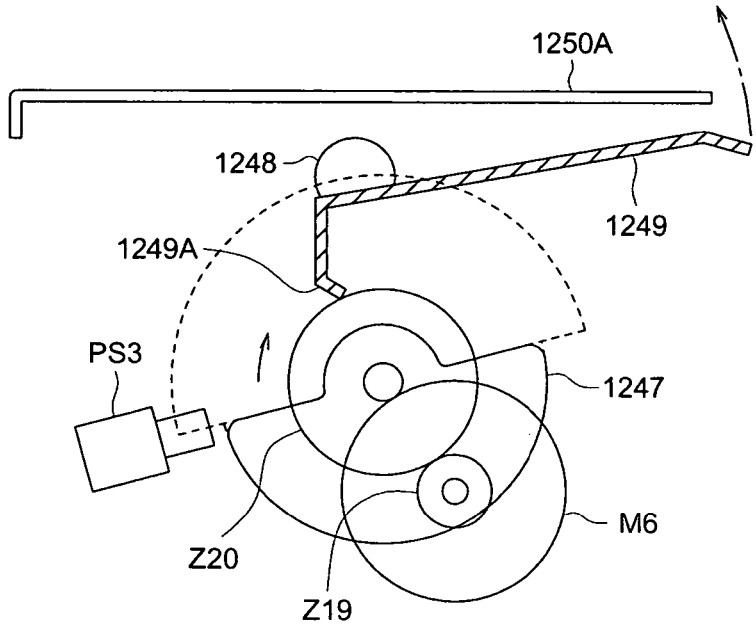
FIG. 18 ( b )
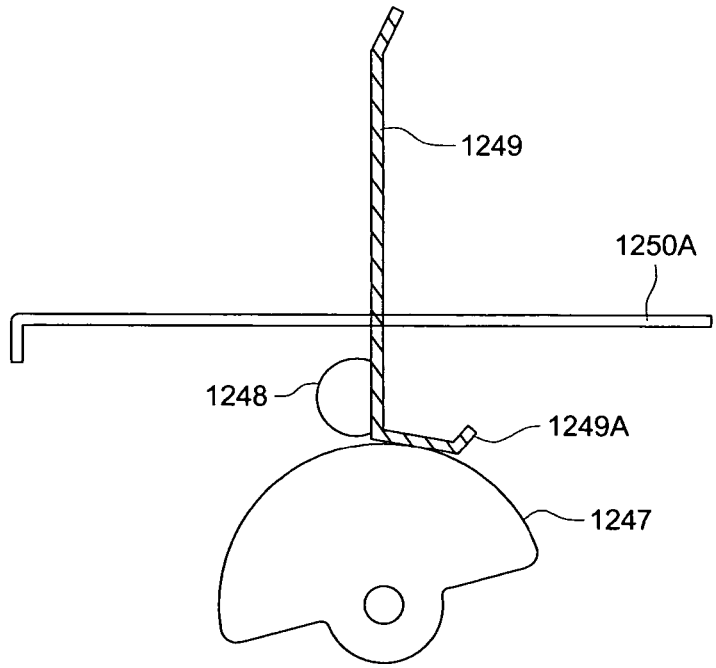

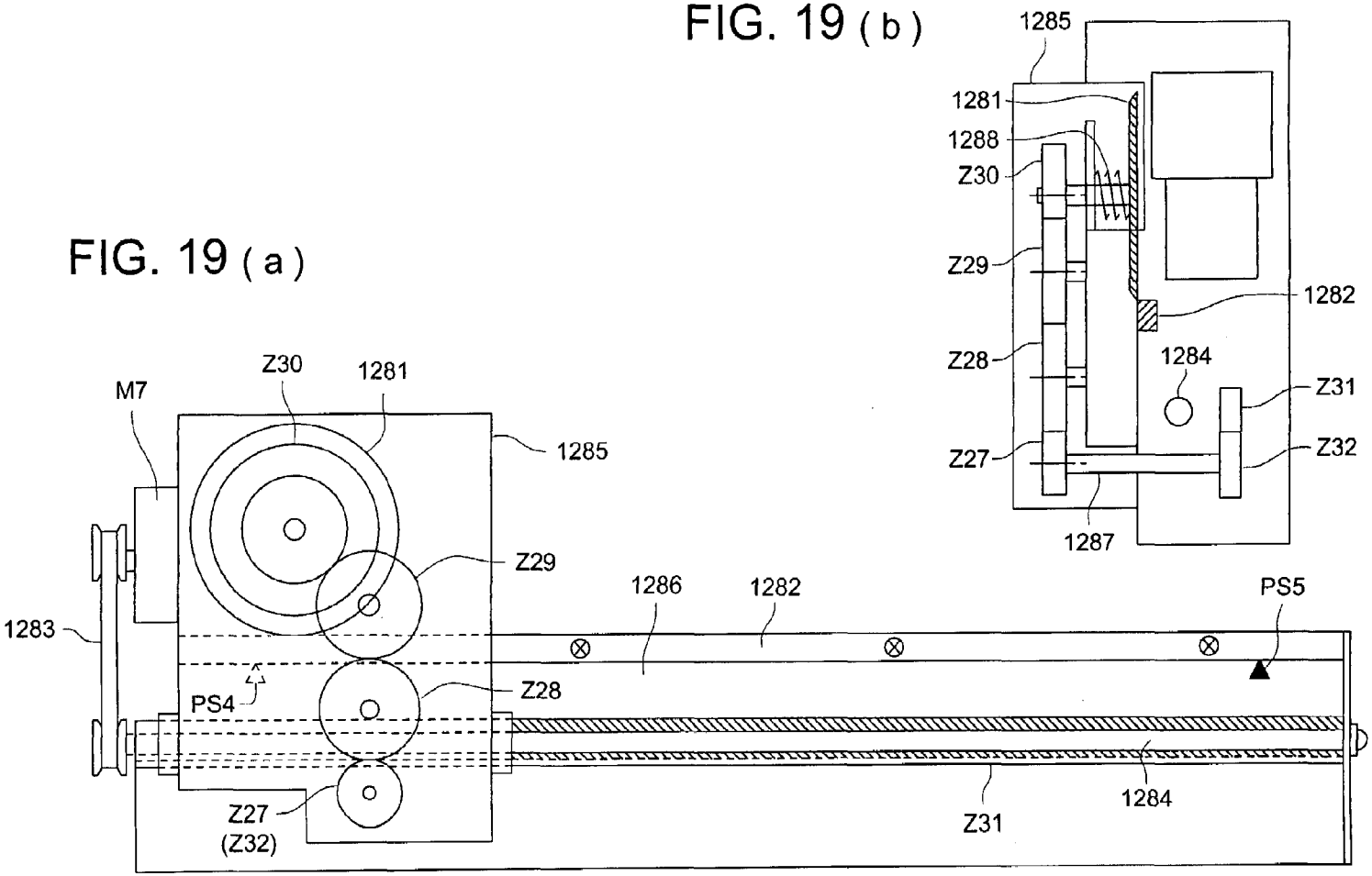
FIG. 19 ( b )
FIG. 19 ( a )

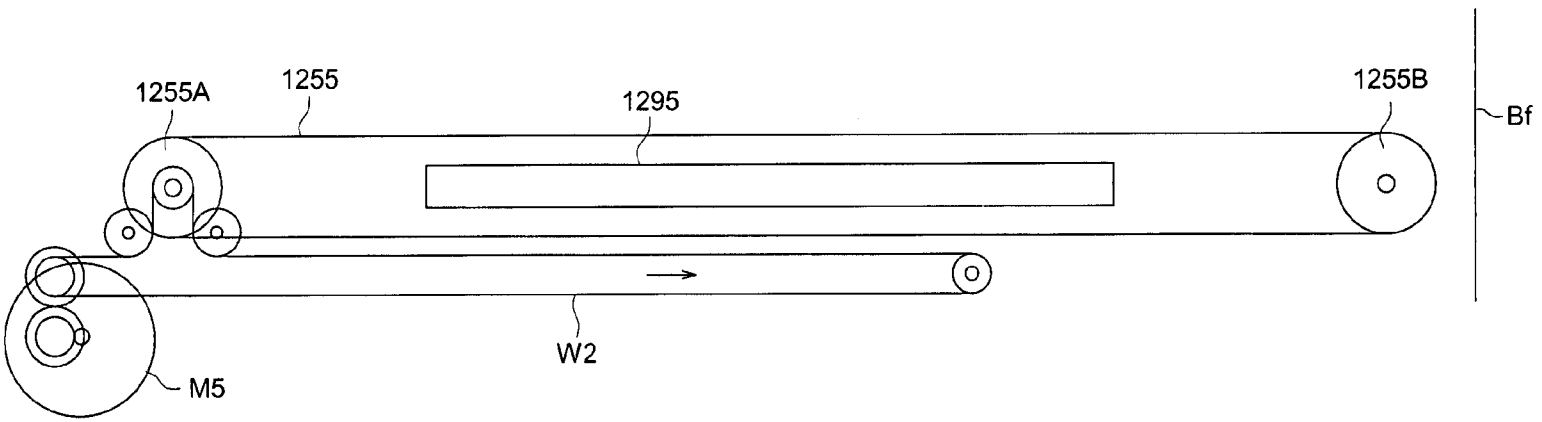
FIG. 32 ( a )
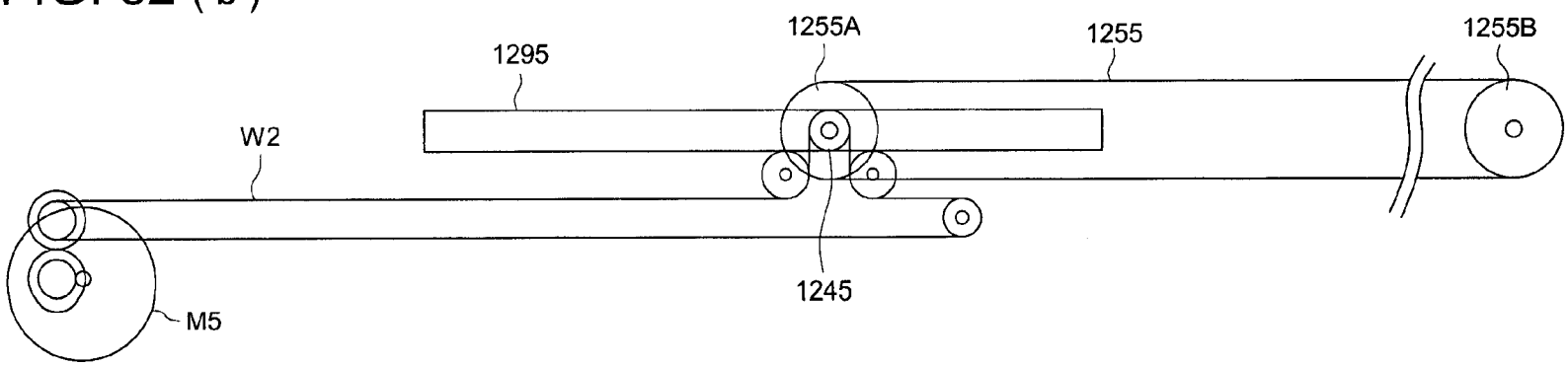
FIG. 32 ( b )

POST PROCESSING DEVICE WITH SADDLE SUPPORT

BACKGROUND OF THE INVENTION

1. Field of the Invention

The present invention relates to a paper sheet conveyance method of a post processing apparatus to handle an image-formed paper sheet, especially, a post processing apparatus for a center-center-folded sheet.

2. Description of the Related Art

In the past, a post processing apparatus functioning to fold or bind paper sheets, which is designed to hook up to an image forming apparatus such as a copier, and an image forming apparatus equipped with the post processing apparatus have been developed and folding processes or technologies to eject stacked and bound paper sheets have been disclosed. (For example, FIG. 5, Page 4 of Laid Open Japanese Patent Application No. 2001-151406 and 2003-182928)

An ejecting configuration for paper sheets disclosed in Laid-Open Japanese Patent Publication No. 2001-151406 is that a folded portion of paper sheet in a valley side of center-folded sheets (dual-folded) contacts a leading edge portion of a paper sheet-supporting device and is loaded thereon, and the paper sheet-supporting device moves and transfers the center-folded sheets to paired rollers provided above the supporting deice, when a number of a paper sheet reaches a predetermined number. Then the center-folded sheets are unloaded. The paired rollers also has a function to load the center-folded sheets, which have been folded by a paper sheet-folding device, to the paper sheet supporting device by rotating the rollers reversibly, which is a feature to minimize the size of apparatus and simplifies the configuration of the apparatus.

In Laid Open Japanese Patent Publication No. 2003-182928, provided is, post processing apparatus, which forms a folded-line at the center of the sheet, by nipping the center of the sheet to a pair of first rollers while pressing the center of the sheet by a holding plate member, and re-creasing the folded portion by a pair of second rollers, which are arranged to move perpendicular to the paper conveyance direction when pressing the folded portion while in motion, when folding a thick bundle of large number of paper sheets.

A book binder having an endless chain to run more than one clamp to handle tied bundles of paper sheets, which greatly improves productivity has been disclosed in, for example, Laid Open Japanese Patent Publication No. 10-35135.

In recent years, customer's demands have increased greatly for a folding process capable of a small to a large number of paper sheets or binding process. However, configurations disclosed in Laid Open Japanese Patent Publication No. 2001-151406 and Laid Open Japanese Patent Publication No. 2003-182928 are likely to exhibit problem such as inferior conveyance and crinkles occurring in the paper sheets. This tends to occur, in case of configurations having a pair of rollers to eject a bound paper sheets. Conveyance force is applied onto the outer paper sheets of the bound of paper sheets and enough force cannot be transferred across the bound paper sheets due to frictions between the paper sheets similarly, even the configuration disclosed in Laid Open Japanese Patent Publication No. 10-35135 exhibits problem is that crinkles are likely to occur at the outer paper sheets of a bundle of such sheets.

In addition, once binding pressure of a pair of rollers or clamps to transfer forces to be applied to all paper sheets of a bundle of such sheets, conveyance force necessary for a bundle of small number of paper sheets cannot be produced. This results in the bundle of paper sheets dropping down while being conveyed or inferior conveyance such as inclination of the bundles of paper sheets, and the post processing apparatus becomes a large structure since binding pressure control equipment is required to function for a bundle of a few paper sheets to one consisting of a large number of paper sheets.

Up to now, a post processing apparatus having a cutting device to trim the edges of the booklets, which have been bound in the middle and/or, folded in the printing industry.

Furthermore, in recent years, copy machines, printers, etc. have been offered, featuring a cutting device, which trims bound sheet edges for booklets such as a weekly magazine, after a center binding process and folding process have been affected.

A cutting device disclosed in registered Utility model No. 2516010 is one which cuts the edges of sheets the booklets after pressing a folded portion by a first pressing member and after a predetermined time pressing adjacent edge portion of the booklet by a second pressing member.

In conventional post processing devices, a too far turned booklet caused by conveyance is corrected by continued rotation of upper and lower conveyer belts (being called overrun-time) for a constant time period after the booklet on which center-binding and center folding processes had been carried out, is conveyed until the leading edge of the booklet in a conveyance direction hits a stopper, as the booklet is sandwiched between the lower conveyance driving belt and the upper following conveyance belt.

In recent years, high productivity bookbinder including post process is required. When shortening of the aforementioned overrun-time in order to satisfy that request, there is a case that a too far turn of the booklet cannot be corrected.

Other weak points were such as occurrence of crinkles and adhesion of foreign matter depending on the variety of paper sheets on which the overrun occurred, since exceeded conveyance turning of a booklet is corrected while the booklet is sliding down between the upper and lower conveyer belts.

Further, another weak point was the possibility that the cover sheet and inner paper sheets are not aligned because the cover sheet as the outer sheet contacts the upper and lower conveyer belts and a the bulky portion of the booklet shifts in the folded direction when a pressure plate presses the booklet.

SUMMARY OF THE INVENTION

The present invention relates to conveyance of a bundle of paper sheets folded in a post processing apparatus and the first aspect of this invention is as follows:

A Post-processing apparatus having a center folding member for making a center folded sheet by forming a folded line on a paper sheet, on which image is formed, a loading member for loading a plurality of center folded sheets by supporting a valley side of the center folded sheets, a supporting member for supporting a folded part or an adjacent folded part of a valley side of the center folded sheets loaded on the loading member, and a driving-means for moving the center folded sheets loaded on the loading member by moving the supporting member.

The second aspect follows:

A method for unloading paper sheets having, folding the paper sheets by a center folding member, stacking a plurality of the center-folded sheets and supporting a folded part or adjacent the folded part of a valley side of the stacked paper sheets by a supporting member, and moving the stacked paper sheets from a pickup position to a delivery position by moving the supporting member from the pickup position to the delivery position.

The third aspect of this invention follows:

A post processing apparatus to process paper sheets ejected from an image forming apparatus having, a center folding member for making a center folded sheet by folding paper sheets on which images are formed, a loading member for loading a plurality of the center folded sheets by supporting a folded part of the valley side of paper sheets folded by the center folding member, a binding member for binding a booklet by binding the loaded paper sheets, a driving-means for moving the paper sheet loaded on the loading member by moving the supporting member, and a cutting device to applying a trimming process on the booklet.

BRIEF DESCRIPTION OF THE DRAWINGS

FIGS. 18(*a*) and 18(*b*) each is a cross-sectional view of a driving mechanism for a reference alignment member.

FIGS. 19(*a*) and 19(*b*) each is a cross-sectional front and side view of cutting device.

FIG. 32(*a*) is a cross-sectional illustration showing the status of an ejecting belt in the post processing apparatus and FIG. 32(*b*) is a cross-sectional illustration showing the status that the ejecting belt is drawn from the post processing apparatus.

DETAILED DESCRIPTION OF THE INVENTION

The first embodiment of the present invention, which is a post processing apparatus and an image forming apparatus integrating the post processing apparatus will be explained.

Figure 1:
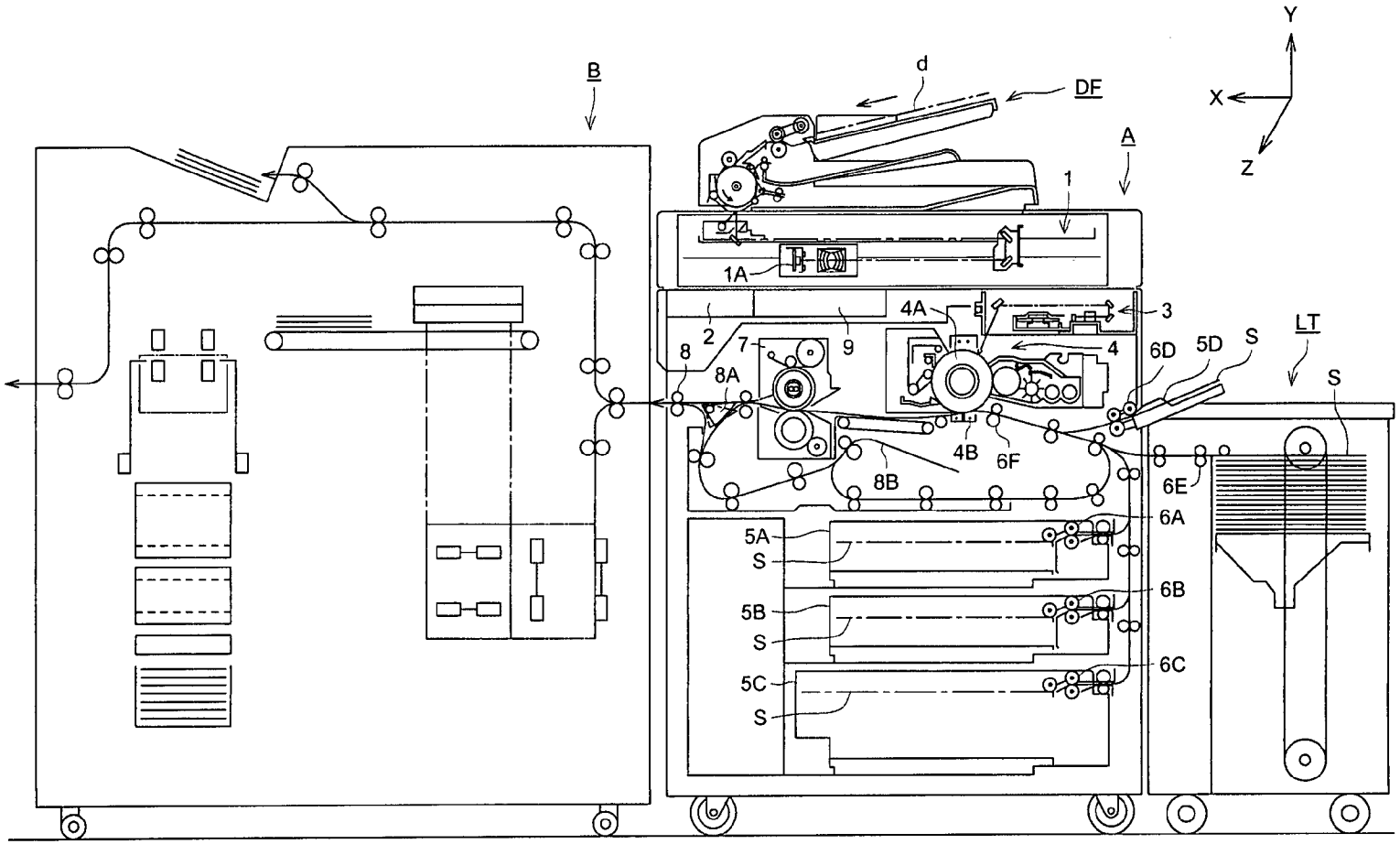
FIG. 1 shows an overall configuration of an image forming apparatus with a post processing apparatus.

FIG. 1 shows an overall configuration of an image forming apparatus with a post processing apparatus.

An image forming apparatus with a post processing apparatus is defined as an image forming apparatus, which is installed with a post processing apparatus, or a configuration integrated with a post processing apparatus, as shown in FIG. 1 and is controllable by an image forming apparatus.

It is possible to configure the post processing equipment to be used alone.

"A" represents an image forming apparatus, DF: an automatic paper feeder, LT: a large capacity paper supplying apparatus and B represents a post processing apparatus.

Image forming apparatus "A" comprising image capturing unit (or image input apparatus) 1, image processing unit 2, image writing unit 3, image forming unit 4, paper supply cassettes 5A, 5B, 5C and manual paper feeder tray 5D, first paper feeders 6A, 6B, 6C, 6D and second paper feeder 6F, image fixing unit 7, paper sheet ejecting unit 8, automatic dual copy unit (ADU) 8B, etc.

Automatic paper feeder DF is provided in the upper portion of image forming apparatus A.

Post processing apparatus B is hooked up to paper ejector 8 provided on the left side surface of image forming apparatus "A" as shown in FIG. 1.

Manuscript "d" on a manuscript table of automatic paper feeder DF is conveyed in the direction shown by an arrow, and images on single or double sides of the manuscript are captured and stored in an image sensor CCD.

Analog signals from image sensor CCD, on which an image has been electrically converted is sent to image processing unit 2 and analog processing, being A/D conversion, shading correction, image compression processing, etc. are carried out, then sent to image capturing unit 3 as image information signals.

Image forming unit 4 forms images using an electronic photographic process and other processes such as electric charging, image exposing, copying and cleaning are carried out. Emitted laser beams based on the image information signals from semiconductor laser (not shown) by the aforementioned exposing process are radiated onto a photosensitive drum whereby an electrostatic latent image is formed. Furthermore, a toner image is formed at aforementioned exposing process corresponding to the electrostatic latent image.

When one of the paper feeders is selected from the group of paper supply cassettes 5A–5C, manual paper tray 5D, large capacity paper supplying apparatus LT and first paper supplying units 6A–6E which correspond to aforementioned paper feeders, paper sheet "S" is conveyed to copying apparatus 4B after which the toner image on photosensitive drum 4A is printed onto the surface of the paper.

Paper "S" carrying a toner image is fixed by the fixing apparatus and ejected from ejecting unit 8 to the post processing apparatus.

In the case of double sided image forming, paper sheet S, on which images are formed on only one side of the paper sheet, is sent to automatic double sided copy paper feeder 8B by conveyance direction switching plate 8A, after which images are formed and fixed on the other side of paper sheet at image forming unit 4, then ejected from ejecting unit 8 to Post processing apparatus B. Operation unit 9 selects and sets a process and functioning of the image forming system comprising image forming apparatus A and post processing apparatus B.

Next, an outline of Post processing apparatus B will be explained by using FIG. 2-5.

Figure 2:
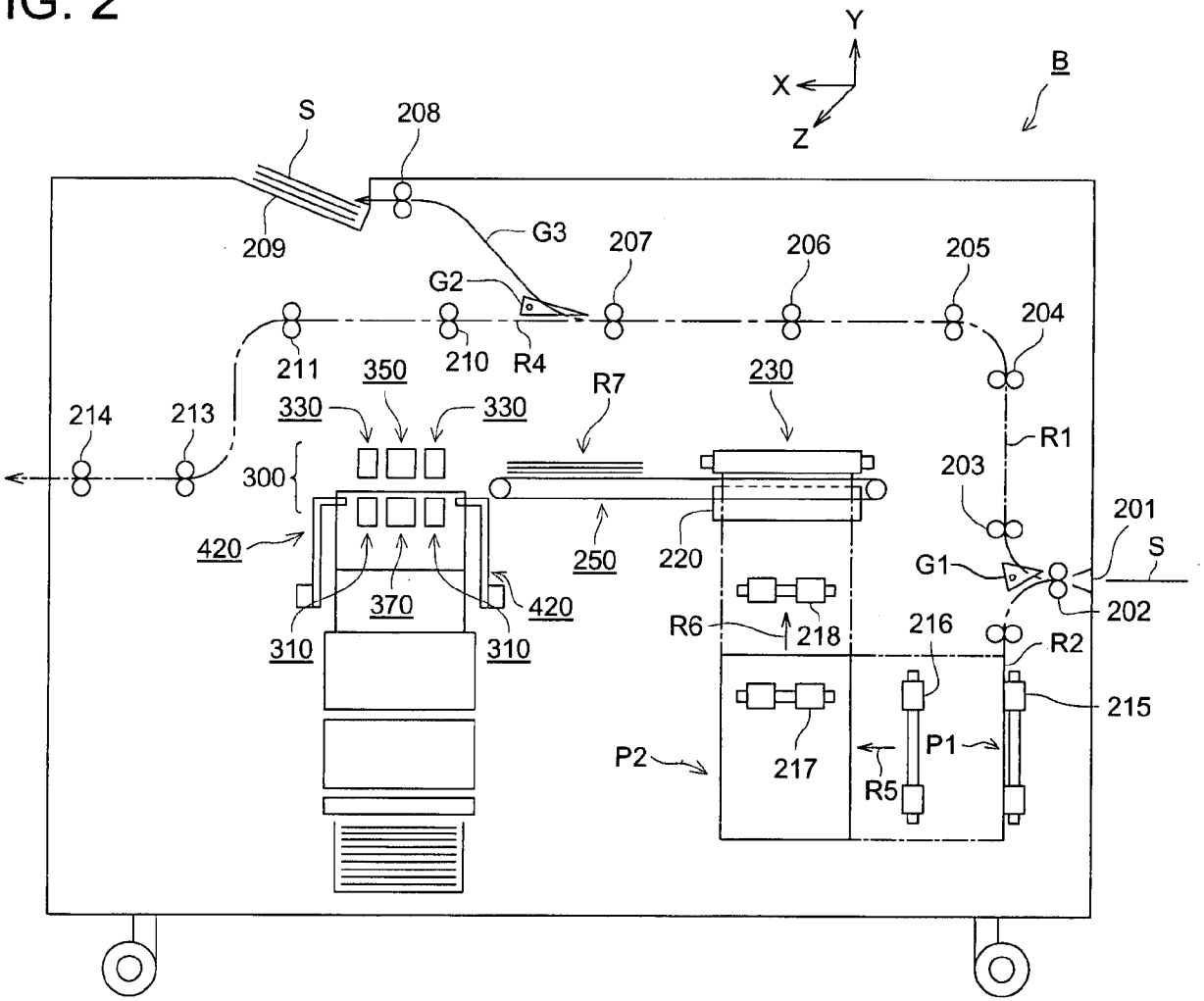
FIG. 2 shows a schematic front view of a post processing apparatus
Figure 3:
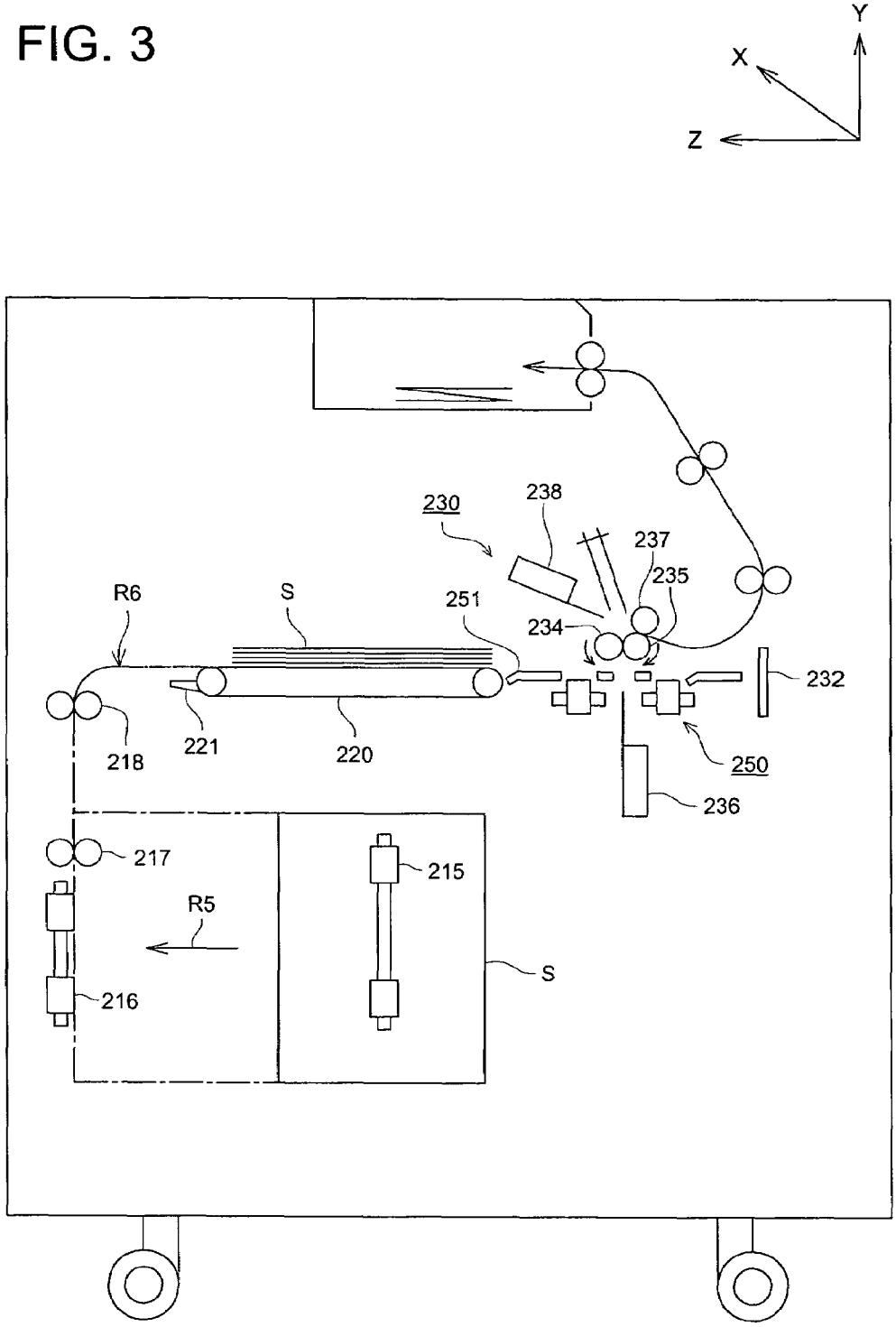
FIG. 3 shows a right side view of the post processing apparatus B shown in FIG. 2.
Figure 4:
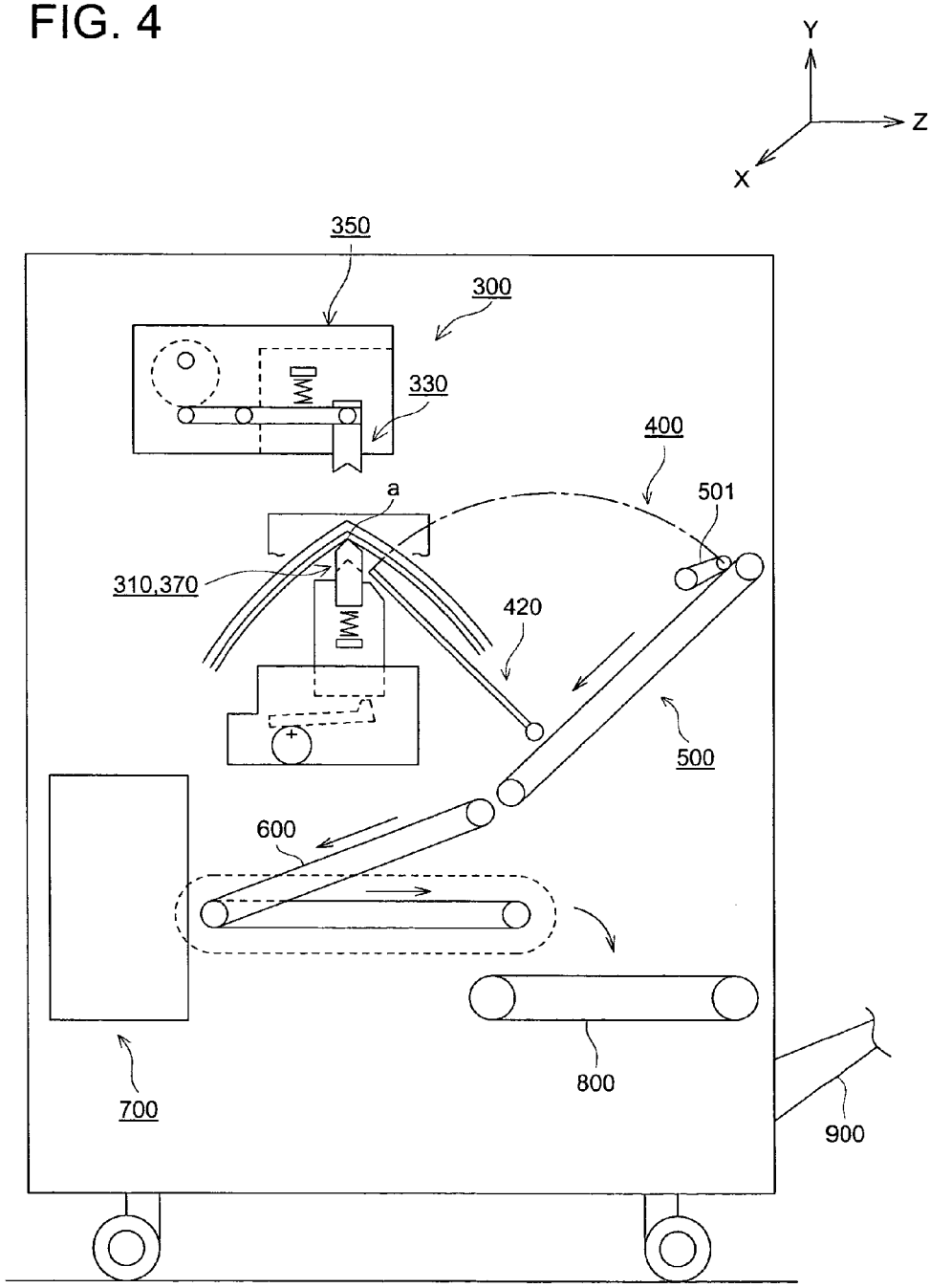
FIG. 4 shows a left side view of the post processing apparatus B shown in FIG. 2.
Figure 5:
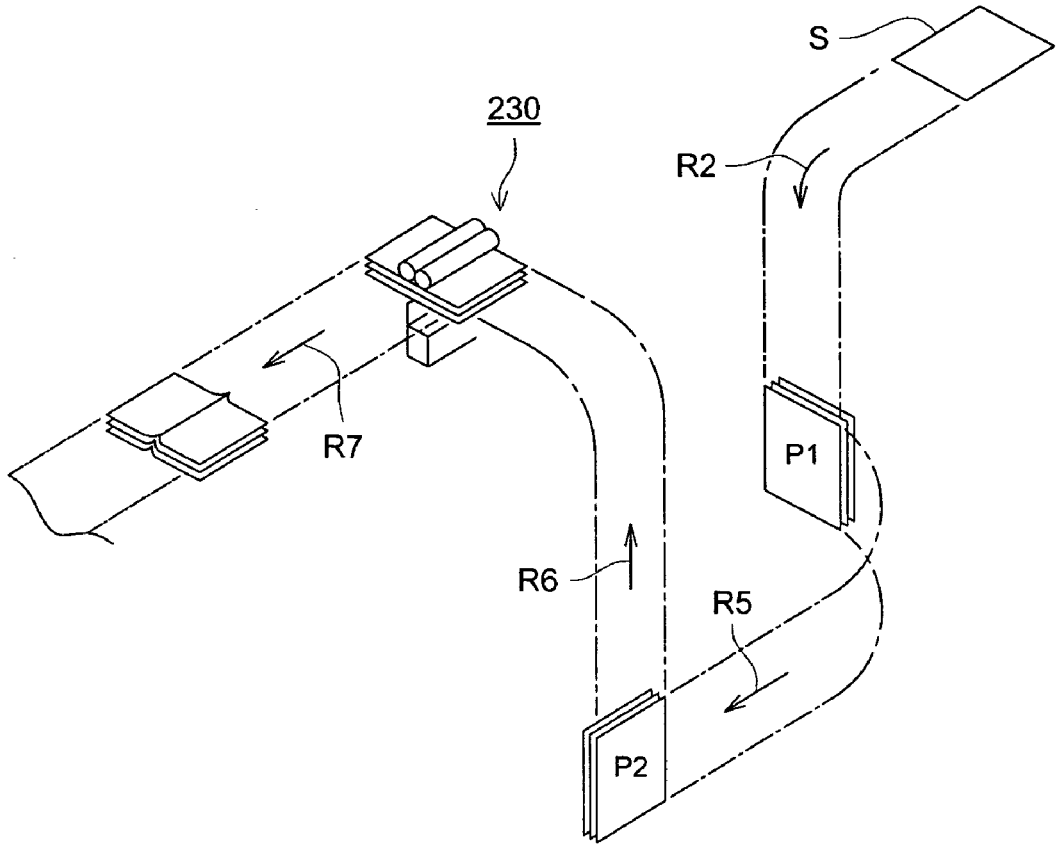
FIG. 5 shows a schematic view of the part of flow of paper sheets in a post processing apparatus.

FIG. 2 is a front view of a post processing apparatus of the present invention; FIG. 3 is a right side view; FIG. 4 is a left side view; and FIG. 5 is a scheme of part of the flow path of paper sheets in a post processing apparatus.

Arrow X, Y, and Z in drawings indicate direction and form a coordinate shaft. In FIG. 2, X represents the horizontal direction; Y represents the vertical direction; and Z represents a perpendicular direction to the paper surface of FIG. 2. Instead of terms horizontal diction, vertical direction and perpendicular direction to the paper surface, X-direction, Y-direction and Z-direction will be used. The positive direction of each coordinate shaft will be expressed as the X-direction, Y-direction and Z-direction which form the rear side to the front side of the paper sheet in FIG. 2, and to designate a negative directions, the terms reverse X-direction, reverse Y-direction and reverse Z-direction will be used.

Paper sheets S on which images are formed in an image forming apparatus is sent to either a conveyance route on which no process is applied, or a conveyance route in which a folding and/or stapling process are applied by conveyance route switch provided at the entrance portion of post processing apparatus B.

Paper sheets Sent to a conveyance route on which creasing and/or staple process is conducted is folded and loaded on a loading member whose shape is a reversed V shape. After the number of loaded paper sheet reaches a predetermined number, a stapling process is applied and the sheet is removed t from the loading member and after an edge-trimming process is applied it is ejected.

Conveyance route R2 with a creasing process and conveyance route R1 without any process R1 will be explained by using FIG. 2.

Paper sheets S, ejected from image forming apparatus "A" into entrance 201 of post processing apparatus B is nipped by entrance roller 202 and switched to either conveyance route R1 provided as upper conveyance route switch or conveyance route R2 provided lower conveyance route switch.

Paper sheets S, sent to conveyance route R1 by conveyance route switch G1 is conveyed by being nipped by paired conveyance rollers 203–207 and sent due to conveyance route switch G2 to either conveyance route R3 provided at above conveyance route switch G2 or conveyance route R4 provided under conveyance route switch G2.

Paper sheets S, conveyed to conveyance route R3 is ejected by paired ejecting rollers 208 to sub-ejection tray (top-tray) 209 provided in the upper portion of the post processing apparatus.

Paper sheets S conveyed to conveyance route R4 is conveyed while successively gripped by paired conveyance rollers, 210–213, and ejected by paired ejecting rollers 214 to another Post processing apparatus.

The paper sheet direction change in conveyance route R2, R5 and R6 will be explained by using FIGS. 2–3.

At entrance 201, paper sheets S conveyed into conveyance route R2 by conveyance route switch G1 is conveyed in the reversed Y direction, pausing temporarily at predetermined point P1.

At position P1, a small number of successive paper sheets S is stacked.

The number of paper sheets Stored is set to three in the above embodiment but it is not limited to three, and can be set as desired.

Three paper sheets S stored at position P1 are conveyed in the Z-direction via paired conveyance roller 215, 216 and a guide plate (not shown), then changed to the X-direction, temporarily pausing at position P2 (conveyance route 5).

From now on, unless otherwise noted, paper sheets S means three sheets of paper S.

Paper sheets S held at position P2 are conveyed in the Y-direction which gripped by paired conveyance rollers 217, 218 and a guiding plate being after which the direction is changed to the reversed Z-direction (being conveyance route R6).

After that, paper sheets S whose direction has been changed to the reversed Z-direction is conveyed to folding member 230 by conveyance aligning belt 220. Center folding member 230 will be explained by using FIG. 3.

Longitudinal travel direction of paper sheets S in this embodiment matches the travel direction of conveyance aligning belt 220.

In FIG. 3 arrows X, Y and Z are the same coordinate axes shown in FIG. 2, the X-direction is from the front to the rear; the Y-direction is from bottom to top; and the Z-direction is from the right to the left.

Center folding member 230 is comprised aligning member 232, folding roller 234, 235 and folding edge 236.

Alignment plate 232 is provided so that the distance from a contacting point of folding rollers 234 and 235 to alignment plate 232 is equal to half the length of the longitudinal dimension of paper sheets S.

Paper sheets S whose direction of travel has been reversed Z-direction is conveyed until the leading edge of paper sheets S touches aligning member 232 after being pushed by alignment cog 221 provided on conveyance alignment belt 220 and conveyed onto guiding plate 251 which is a party of folding member 250 which will be explained later.

Then, the back-edge of paper sheets S (three paper sheets S) is pushed back and forth in the conveyance direction by the reciprocating movement of alignment cog 221 and the width in the conveyance direction is aligned.

After the aforementioned alignment operation is completed, folding edge 236 provided under the contacting point of folding rollers 234 and 235 pushes up the center portion of a rectangle of paper sheets S and nip between folding roller 234 and 235 being rotated in opposite direction from each other as shown by arrows in FIG. 3.

After inserted paper sheets S as folded by folding rollers 234 and 235, inserted paper sheets S as returned on guide-plate 251, by the reversed rotation of folding rollers 234, 235, then conveyed in the X-direction on guide plate 251, which is explained later.

Position of alignment plate 232 and operations, etc. of alignment belt 220 are configured so that they are changed by a controller (not shown) corresponding to a paper size change, when the paper size is changed.

Further, it is also possible to employ rollers 235, 237 and folding edge 238 when folding a paper sheet in Z-shape folding (folding paper sheets S in Z-shape; being three folding).

Referring back to FIGS. 2 and 5, paper sheets S, which has been folded at the center of a longitudinal side of the paper sheet, is conveyed in the X-direction to the next the process, binding process 300, by conveyance cog 252 provided on the conveyer belt in conveyance member for folding 250 and guide-plate, etc. (not shown). (Conveyance route R7) Further, paper sheets S, which is sent out from center folding paper sheets conveyance member 250, are stably transferred to paper sheet binding process 300 since the stiffness of paper sheets S is enhanced because paper sheets S are folded in the conveyance direction.

Paper sheet binding process 300 is explained by using FIG. 4.

Paper sheets S, which are folded by center folding member 230, proceed in the direction of conveyance route R7 (shown as the X-direction) by paper sheet conveyance member 250 and loaded on loading member 310 shaped in a reverse V-shape, provided in paper sheet binding process 300 by alignment member and guide member, which are not shown. Successive center-folded sheets S are also stacked on loading member 310 via conveyance route R7.

Loading member 310 comprises a supporting member to support a folded portion of paper sheets S, whose shape is an inverted "V", and a supporting member to support circumference-edge of paper sheets. The supporting member to support folded portion supports the folded portion "a" in the valley side of center-folded sheets S and the supporting member supports the circumference-edge portion in the valley side of center-folded sheets S. A valley side of center-folded sheets S means the inner facing and the outside surface is called mountainside, when folding a paper sheet in a crease.

Stapler 350 is installed in the upper area of loading member 310. Staple-receiving member 370 is provided so as to move up and down under the center-folded sheets loaded inside of loading member 310. Two set of a two-part structure binding member, having a stapler and a staple receiving member are provided in the folded direction of paper sheets S.

The position of a plurality of paper sheets S placed on loading member 310 are trued up and the fold of each paper sheet is trued up as well by pressing member 330.

When the number of paper sheets S reaches a predetermined number, pressing member 330 descends and stapler 370 rises with keeping paper sheets S pressing in between, whereby a bundle of paper sheets S are stapled along the folded portion of paper sheets S. Namely, the pair of binding member staple a bundle of paper sheets S on loading member 310 at two points which are same distance from a center of the paper sheets S.

Unloading process 400 for bound paper sheets S is explained by using FIG. 4.

Supporting member 420, which can move freely, carries the bound paper sheets in binding process 300 in the dashed line direction, so that the mountain side of the bound paper sheets S is supported by conveyer belt 500. Then, gripper 501 provided on conveyer belt 500 holds a bulky portion of the bound paper sheets. The bound paper sheets are conveyed in a downward sloping direction by rotation of conveyer belt 500 while held by gripper 501, and then carried to a predetermined position by conveyer belt 600, after being released by gripper 501.

After that, conveyer belt 600 swings to the horizontal position. The edge of the bound paper sheets (an open edge opposite of the folded edge), which is irregular due to a number of paper sheets making up the bound of paper sheets, is trimmed by cutting device 700 (trimmer) to provide a smooth edge.

The bound paper sheets having been trimmed by cutting process is placed on conveyer belt 600, which rotates reversibly, and is a conveyed by a projection (not shown) fixed on conveyer belt 600 to the edge of conveyer belt 600. The paper sheets are dropped in the direction of an arrow as shown. The paper sheets dropped are ejected to ejecting tray 900 provided on the extension of the front of post processing apparatus B by rotary conveyer belt 800.

After that, the above mentioned operation continues until a predetermined number.

A control device in the post processing apparatus controls the above operations, however a control device in an image forming apparatus can also be used.

Figure 6:
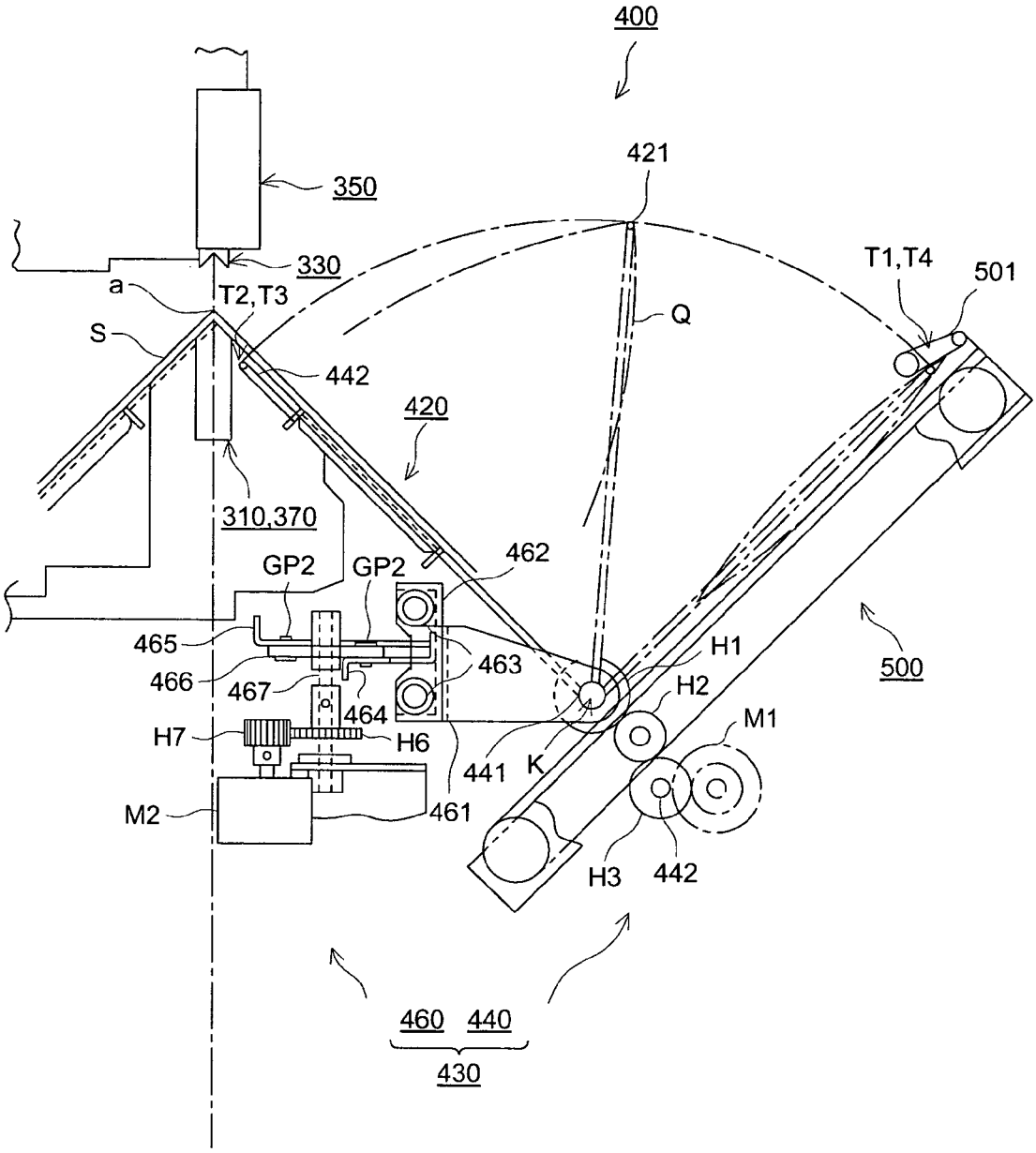
FIG. 6 is an enlarged front view of the unloading step shown in FIG. 4.
Figure 7:
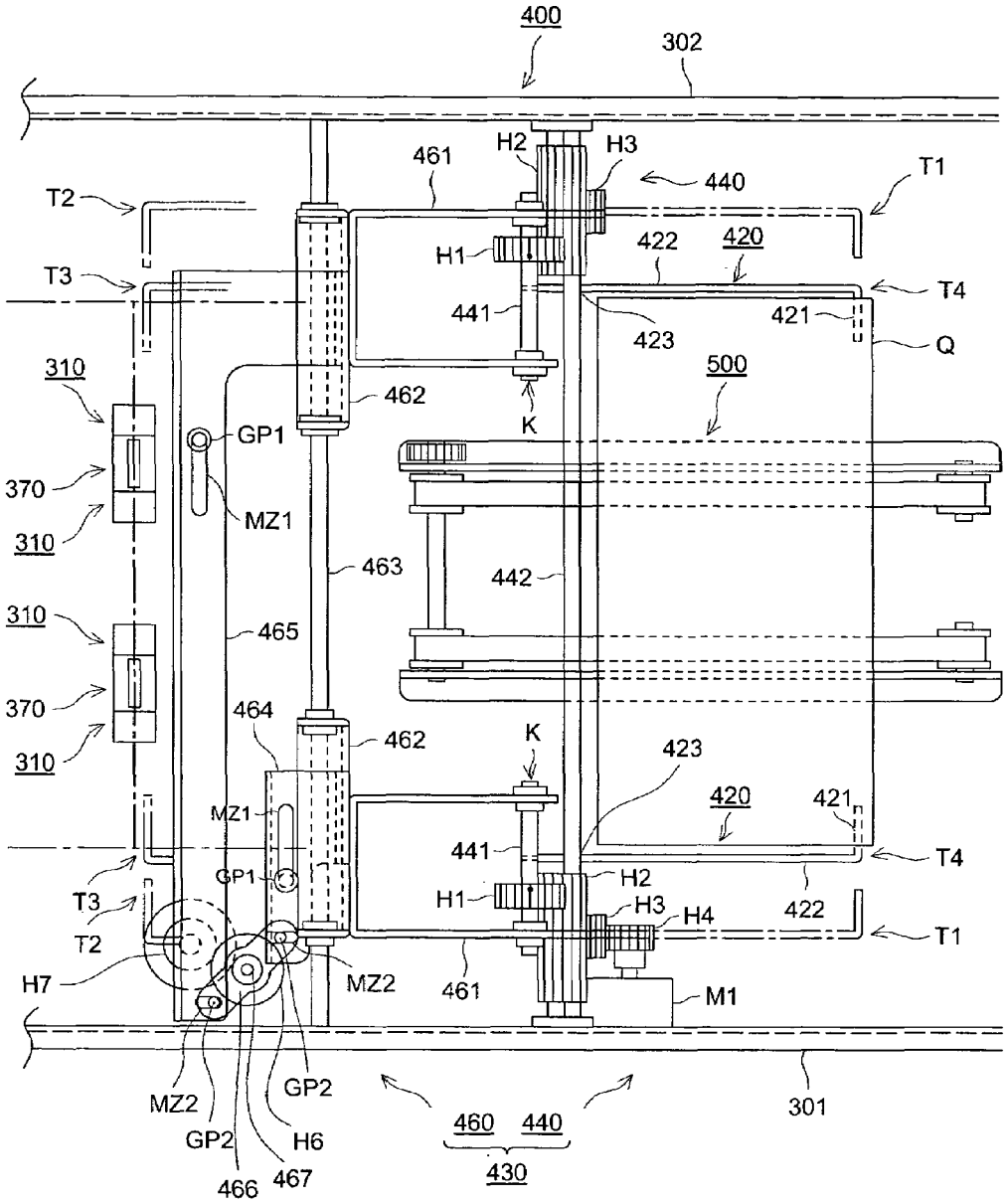
FIG. 7 is an enlarged top view of the unloading step shown in FIG. 4.

Detail explanation of unloading process 400 including a supporting member and an driving means is explained by using FIGS. 6 and 7.

FIG. 6 is an enlarged front view of unloading process 400 shown in FIG. 4 and FIG. 7 is an enlarged top view of unloading process.

Unloading process 400 has supporting member 420 functions to eject bound of paper sheets when a number of paper sheets on loading member 310 reaches a predetermined number (it is fifty in this embodiment) and driving means 430, etc.

Driving means 430 is comprised of swinging member 440 and moving member 460.

Additionally, in the following explanations "bound paper sheets S" is called "bound paper sheet Q".

Firstly, the supporting member will be explained.

Supporting member 420 is configured of a pair of bar type members comprising supporting member 421 whose shape is substantially an L shape, and longitudinal member 422.

In regard to longitudinal member 422, end portion 423 opposite to supporting member 421 is fixed to swinging shaft 441.

Supporting member 420 swings on center K of swinging shaft 441 by swinging member 440, and supporting member 421 moves from an area adjacent to folded portion "a"

(hereinafter called pickup position) to an area which passes booklet Q to receiving conveyer 500 (hereinafter it is called delivery position).

Supporting member 421 of supporting member 420 is arranged to be substantially parallel to folded line "a" at the pickup position.

Next, swinging member 440, which swings supporting member 420, will be explained.

Paired swinging shaft 441, mentioned above, is roratably supported on swing arm holding member 461, which configures moving member 460, and which will be explained later.

Paired gears H1 are fixed to a pair of swinging-shaft 441 and gears H1 are connected to gear H2 supported on a rotary support-shaft (not shown) fixed to side plates 301 and 302. (Refer to FIG. 7)

Paired gears H2 is engaged with paired gears H3 fixed on rotating shaft 442 is supported by side plates 301 and 302.

One of the paired gears H3 is, for example, engaged with gear H4, fixed with the output shaft of swinging motor M1, for which a stepping motor is used for example, for driving the swinging member.

Swinging member 440, configured as explained above will now be explained.

The normal or reverse rotation of swinging motor M1 rotates swinging shaft 441 via gears H1–H4. Whereby, supporting member 420 moves back and forth between the pickup position and the delivery position as supporting member 420 being rotated on center K of swinging shaft 441.

As shown in FIG. 6, swinging shaft 441 is positioned away from the top portion of loading member 310, or positioned away from the folded portion of loaded paper sheets. It is possible to unload even a large number of paper sheets securely without damage, since supporting member 420 rotates to pickup bound paper sheet Q in the right upper direction from the left-lower portion without unduly pressing the paper sheets, which are a part of the bound paper sheets.

Next, moving member 460 will be explained.

Moving member 460 functions to move supporting member 421 from a position where supporting member 421 of supporting member 420, supports bound paper sheet Q (hereinafter called "supporting position") to a position away from the edge of paper sheets (hereinafter called "remote position")

A pair of swing arm holding member 461 is fixed to a pair of slide block 462, and which is held on slide shaft 463 so that the slide block moves freely in parallel to a folded line "a" of paper sheets S.

Slid shaft 463 is fixed to side panels 301 and 302.

First link plate 464 and second link plate 465 are fixed onto the pair of slide block 462.

Slots MZ1 are formed in the longitudinal direction and parallel to slide shaft 463, and on first link plate 464 and second link plate 465, and MZ1 is linked with guide pins GP 1 so that these link plates can move freely.

Guide pins GP 1 are fixed to a bottom plate (not shown) and linked with side plates 301 and 302.

Further, slot MZ2 are formed on first link plate 464 and second link plate 465 so that the longitudinal direction of slots MZ2 are at a right angle to shaft 463, and is linked with guide pin GP2 so that guide pins GP2 can move freely against first link plate 464 and second link plate 465.

The two guide pin GP2 are fixed at both ends of driving link 466, and link rotating shaft 467 is provided and fixed at a center position between the two guide pin GP2 on driving link 466.

Gear H6 is fixed to link rotating shaft 467, which is supported by aforementioned bottom plate so that the link-rotating shaft rotates freely.

Gear H6 engages to gear H7, fixed to an output shaft of sliding motor M2 including for example, a stepping motor provided and fixed on side plate 301.

The aforementioned configuration of moving member 460 will now be explained.

As slid motor M2 rotates, link rotating shaft 467 and driving link 466 rotate. Then paired supporting member 420 fixed on swinging shaft 441 moves to widen or shorten the distance between both supporting member 420 as paired slide blocks 462, fixed on first link plate 464 and second link plate 465, and paired of swing arm holding members 461 are slid in the opposite direction to each other. As a result, paired supporting member 420 can move the same distance at the same time in a direction parallel to folded portion "a" of paper sheets S. Namely, supporting member 420 moves between the aforementioned supporting position and remote position.

When a paper sheets Size change occurs, slide motor M2 rotates based on the width of the paper sheets Size, to slide swing-bar holding member 461 so that supporting member 420 moves.

As described above, supporting member 420 swings between aforementioned pickup position and delivery position by swinging member 440 due to rotation of the shaft of swinging motor M1 and moves between aforementioned supporting position and remote position by moving member 460.

Supporting member 420 is configured so that it moves sequentially within four positions based on a combination of aforementioned swinging member 440 and moving member 460, which will now be explained as follows.

T1: pickup/evacuated position; a position determined by a combination of aforementioned "delivery position" and "remote position" and a position where supporting member 460 receives bound paper sheets Q and has transfer them to receiving conveyer 500.

T2: pickup/standby position; a position determined by a combination of aforementioned "pickup position" and "remote position" and supporting member 421 of support member 460, positions adjacent to folded portion of the valley side surface and away from paper sheets S.

T3: pickup/start position; a position determined by a combination of aforementioned pickup position and supporting position and supporting member 421 of supporting member 460 is located at a position where supporting member 421 is inserted to adjacent folded potion of valley side of a bound paper sheets S and supports bound of bound paper sheet Q.

T4: pickup/finishing position; a position determined by a combination of aforementioned delivery position and aforementioned support position and where supporting member 460 receives bound of paper sheet Q and transfers them to conveyer 500.

Further, the phrase "a position adjacent to the folded portion" in the present invention means a supporting member of the present invention or a gripper located within the area where the objective of the present invention is attained and an area away from the folded portion of paper sheets S but less than half the distance; "distance" means the total length at right angle to the crease of center-folded sheets S, and preferably less than one fourth of the total length of paper sheets S.

The pick-up operation of bound paper sheet Q from loading member 310 described above will be explained now.

When the number of paper sheets S loaded on loading member 310 reaches a predetermined number, swinging motor M1 rotates each gear of swinging member 440, which swings supporting member 460 counterclockwise from position T1 to T2. Then, sliding motor M2 of moving member 460 rotates to move supporting member 460 from T2 to T3, to support bound paper sheet Q loaded on loading member 310. After that, swinging motor M1 of swinging member 440 rotates supporting member 460 in clockwise from T3 to T4 through each linked gear and completes pickup operations. After finishing pickup operations, slide motor M2 of moving member 460 moves supporting member 420 from T4 to T1 by rotating driving link 466 linked to supporting member 420, whereby receiving of bound paper sheet Q and delivery to conveyer 500 is completed.

As described above, the pickup operation based on the present invention can pick up a large number of bound paper sheets having a large number of paper sheets without giving pressure to bound paper sheets comparing to conventional roller based pickup operations, since when a number of paper sheets on a loading member reaches a predetermined number, a supporting member rotates on a rotation center to pick up bound paper sheets to right upper direction from left lower portion.

Additionally, in this embodiment, the shape of the supporting member approximates an L-type bar but it is not limited to such L-type bar member as long it supports adjacent to the folded portion of the valley side of paper sheets, for example a circular plate with projections to support the paper sheets is viable.

In regard to the loading member, a reverse V type was used in the present embodiment of present invention, but it is not limited to this, for example, a mountain type is allowed as long as it is able to load a valley side of paper sheets steadily.

Further, in order to pick up paper sheets, a supporting member is rotated in this embodiment, but a-mechanism, which can move the supporting member away from the loading member, for example, a sliding mechanism, can also be used to pick up the paper sheets.

In addition, in this embodiment, a link mechanism was used, however, a timing belt, a mechanism having a combination of a wire and pulley, or a rack-pinion mechanism are also viable.

When changing for a different paper size, it is possible to change the operation position of supporting member to correspond to the width of the different paper sheet size by providing a sensor to detect the paper sheet size, for example, on a sliding mechanism on which the paper sheet is set.

In this embodiment, the number of paper sheet, which were folded at the same time was 3, but it is not limited to this and can be changed appropriately. Even one page is acceptable.

Also in this embodiment, the stapling process was used but it is not essential to use the stapling process with the present invention, in which the number of paper sheet, which can be loaded was fifty in this embodiment but any reasonable number can be set.

The second embodiment of the present invention is explained referring to drawings.

Figure 8:
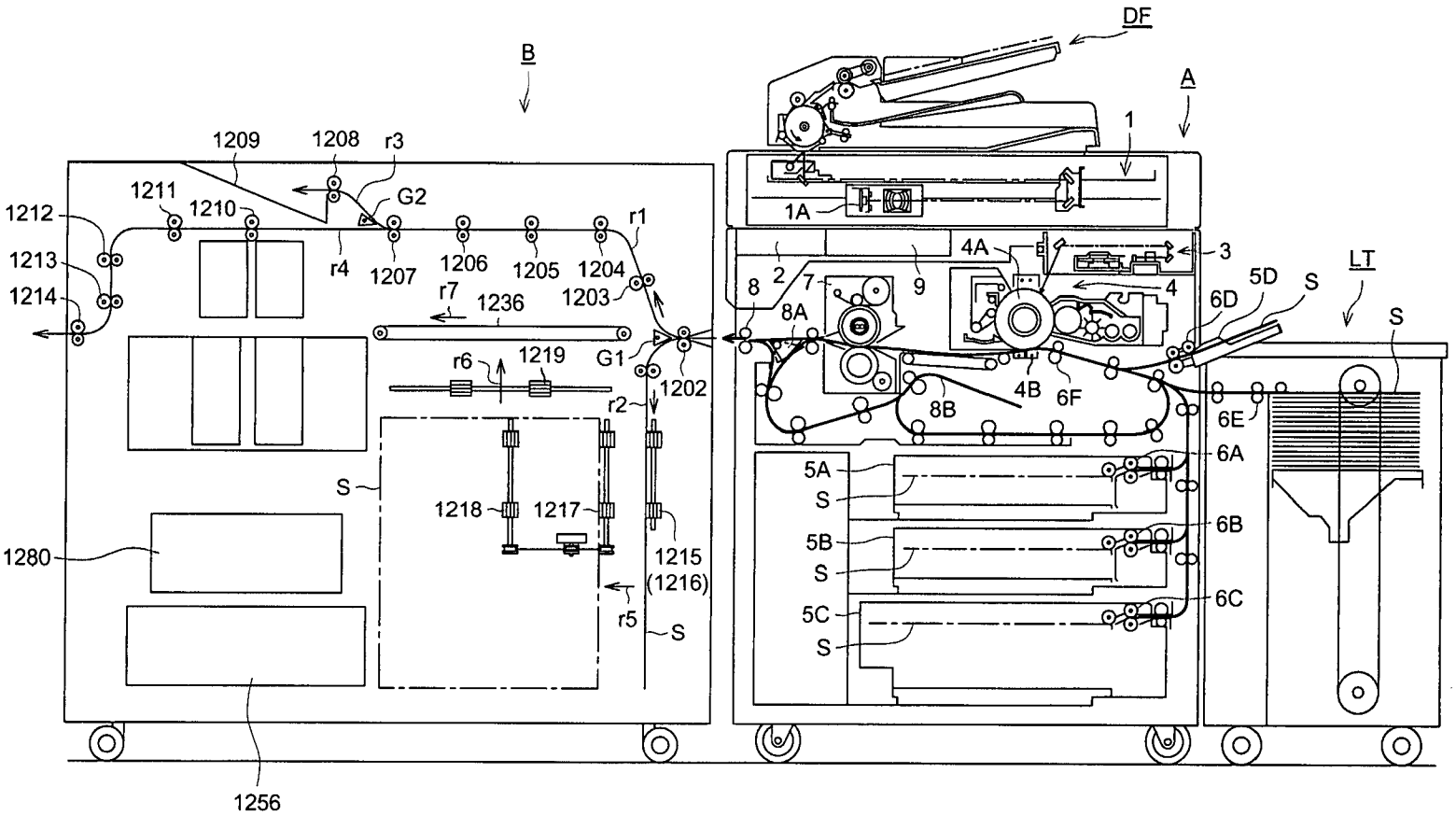
FIG. 8 is an overall configuration of an image forming system comprising an image forming apparatus, an automatic paper feeder, a post processing apparatus and a large capacity paper supplying apparatus.

FIG. 8 is similar to FIG. 1, being a drawing of the overall configuration of an image forming system having image forming apparatus A, automatic paper sheet feeder DF, post processing apparatus B and large capacity paper supplier apparatus LT.

(Post Processing Apparatus)

Figure 9:
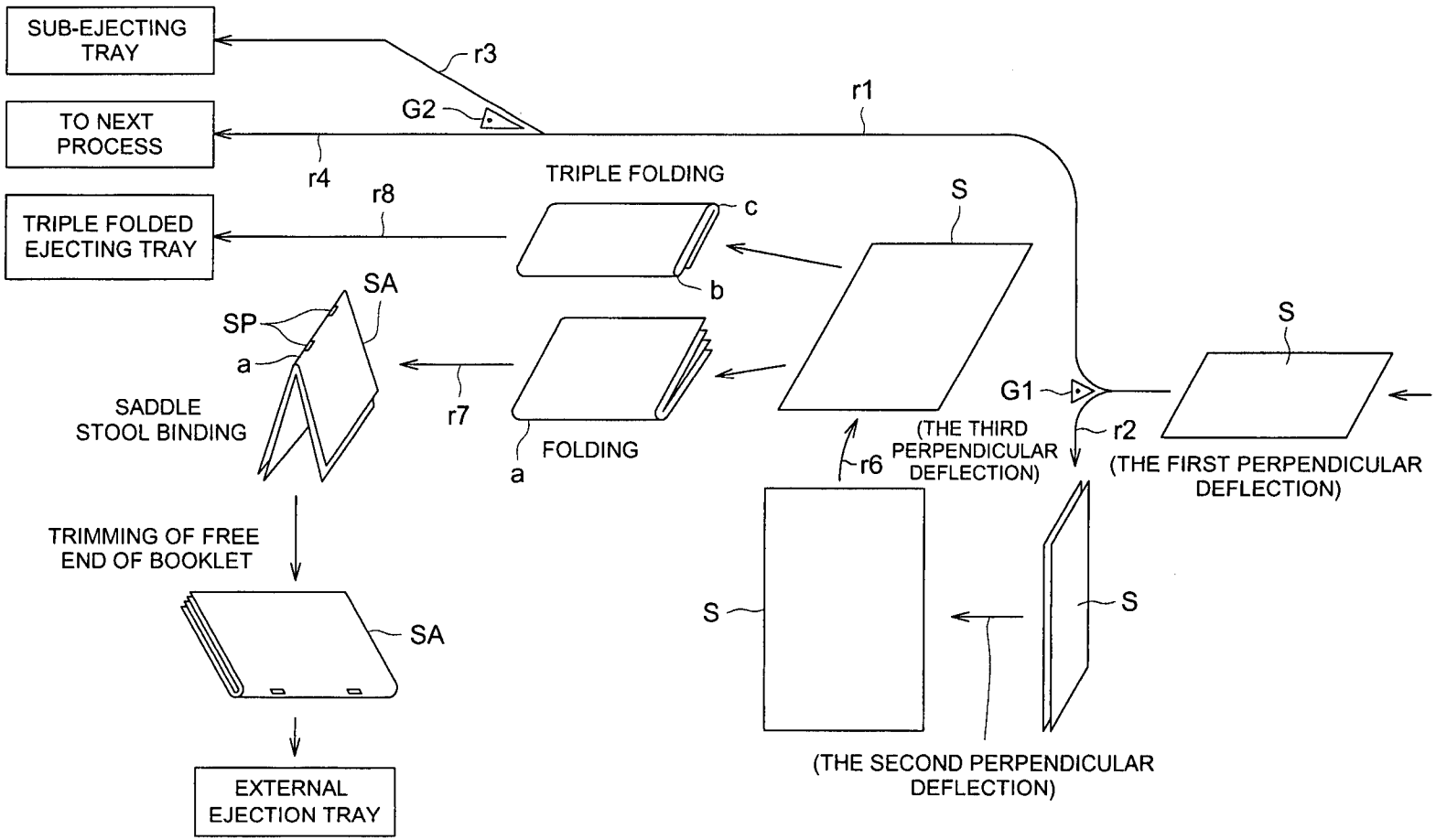
FIG. 9 is a schematic of a paper sheet conveyance step of a post processing apparatus.
Figure 10:
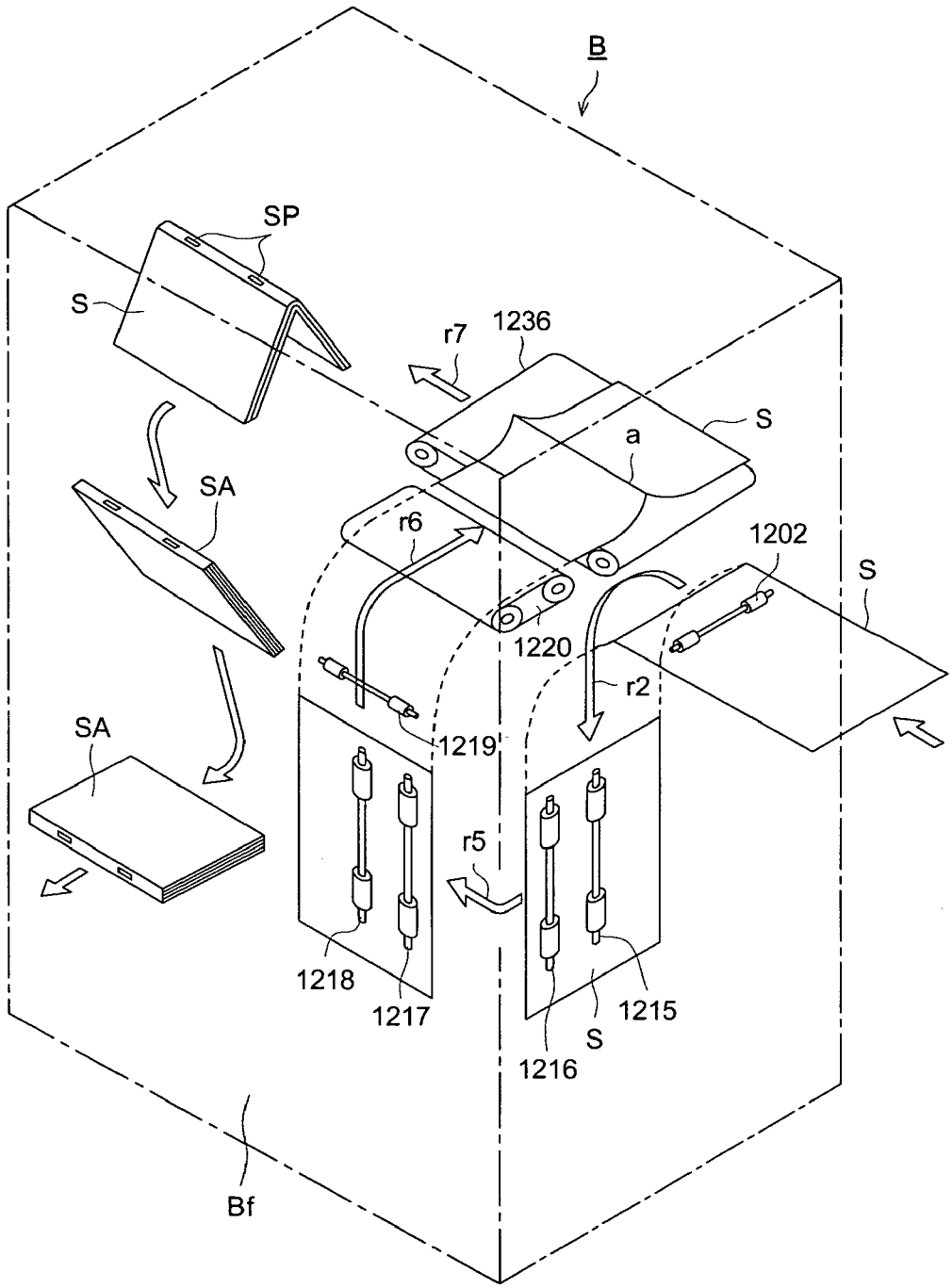
FIG. 10 is a schematic of a paper conveyance step in a creasing step and a binding step in the post processing apparatus.
Figure 11:
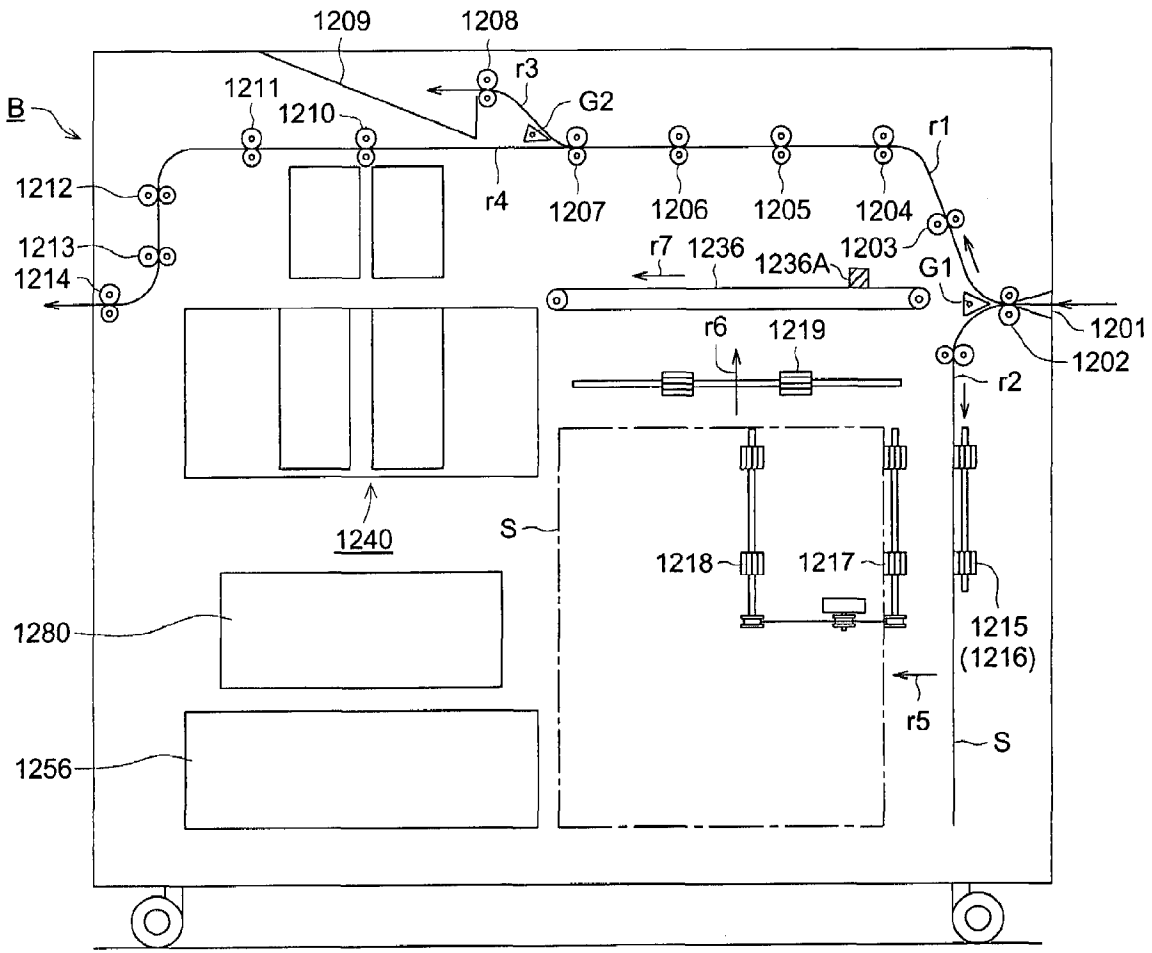
FIG. 11 is a front view of the post processing apparatus.
Figure 12:
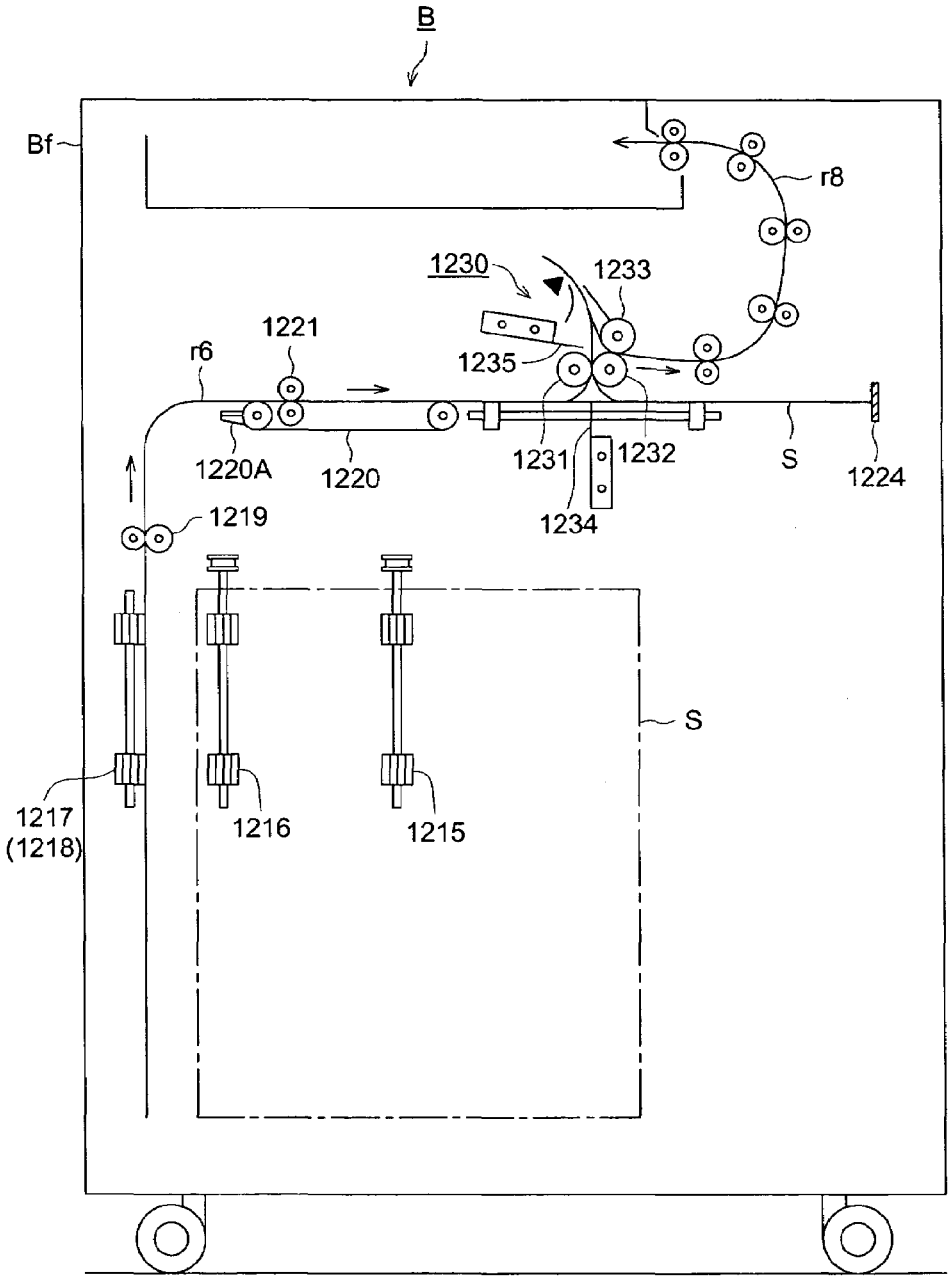
FIG. 12 is a right side view of the post processing apparatus.
Figure 13:
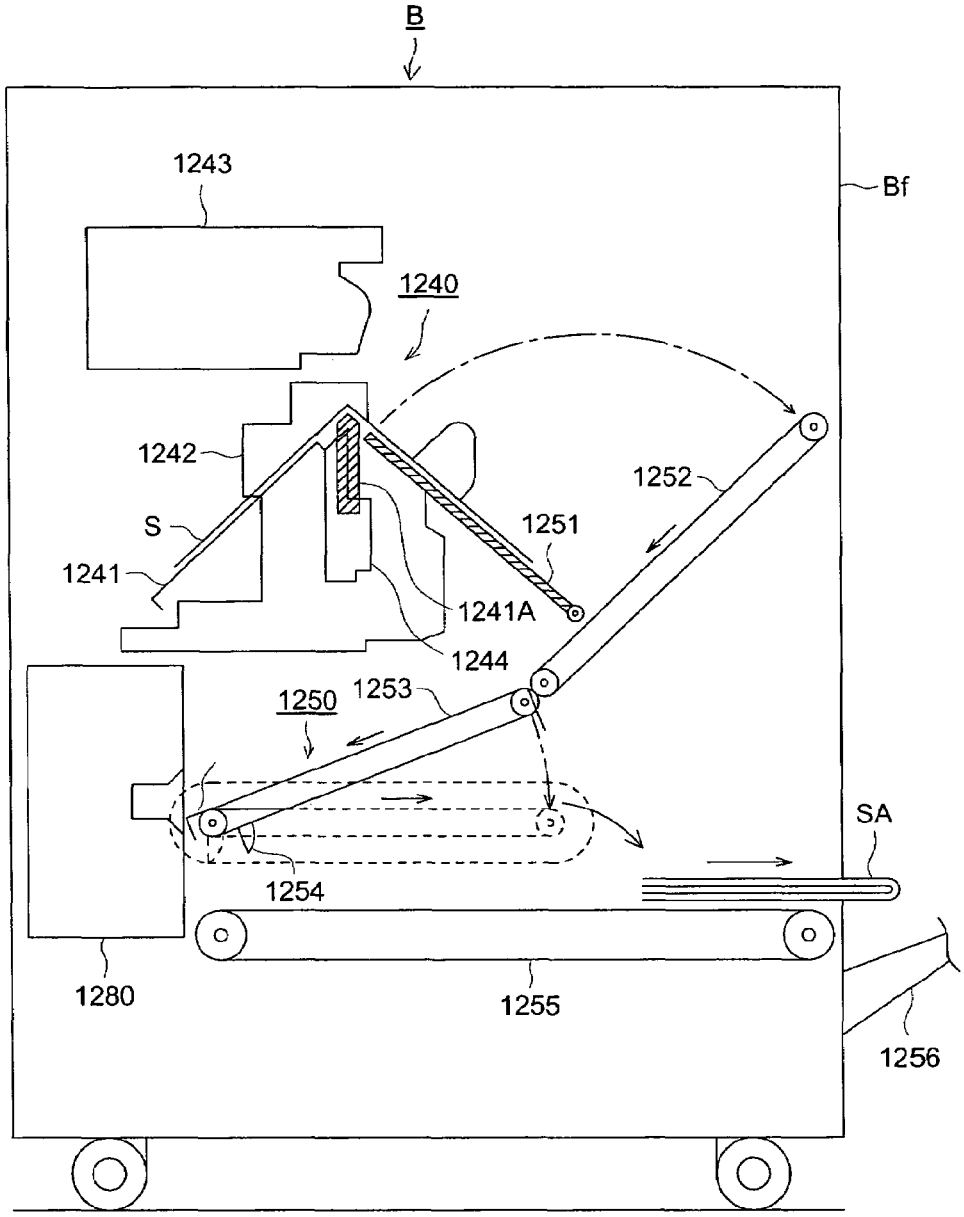
FIG. 13 is a left side view of the post processing apparatus.

FIG. 9 is a schematic drawing showing the paper sheet conveyance steps of the post processing apparatus. FIG. 10 is a schematic showing a paper sheet conveyance sequence of a center folding and a center binding process. FIG. 11 is a front view of post processing apparatus; FIG. 12 is a right side view; and FIG. 13 is a left side view.

Firstly, a paper sheet conveyance sequence from a paper sheet inlet to the folding step will be explained.

As shown in FIGS. 9 and 11, paper sheets S ejected from image forming apparatus A being fed into entrance portion (inlet portion) 1201 is nipped by paired inlet rollers 1202 and conveyed to either conveyance route r1 or conveyance route r2 by conveyance route switch G1.

<Straight-Ejection>

Paper sheets S deflected to conveyance route r1 is sent again by conveyance route switch G2 after passing through paired conveyance rollers; 1203–1207, to either upper conveyance route r3 or lower conveyance route r4.

Paper sheets S deflected to upper conveyance route r3 are ejected by paired ejecting paper sheet roller 1208 and conveyed to subset ejecting tray (top tray) 1209 provided on the upper portion of post processing apparatus B.

Paper sheets S deflected to lower conveyance route r4 are conveyed by conveyance rollers 1210–1213 after which paper sheets S are inserted and ejected by paired paper sheet ejecting rollers 1214.

<The First Perpendicular Turning Conveyance>

Paper sheets S conveyed to conveyance route r2 provided under conveyance route switch G1 drop down in an approximately vertical direction, paused temporarily and are then stored at a predetermined position. In this way, a plurality of paper sheets S are stacked and stored.

<The Second Perpendicular Turning Conveyance>

Stored paper sheets S are conveyed and turned in a direction, which is perpendicular to the paper sheet surface of FIG. 9 by paired conveyance rollers 1215–1218, and then pass through conveyance route r5, which is curved toward front side Bf (see FIG. 12) in post processing apparatus B, which holds paper sheets S in an upright position.

<The Third Turning Conveyance>

Next, after paper sheets S is lifted vertically by conveyance roller 1219, paper sheets S are turned to the horizontal direction, and then shifted toward an alignment member by conveyance alignment belt 1220 and conveyance paired rollers 1221 on conveyance route r6.

<Alignment Prior to Folding Process>

An alignment process is provided at down-stream of paper sheets conveyance direction in conveyance route r6, and the alignment member having alignment member 1224, against which the leading edge of the paper sheets are contacted and aligned and positioned, movable alignment block (a alignment lick) 1220A to push the back edge of paper sheets and move. The alignment block 1220A pushes paper sheets, which have been conveyed by conveyance roller 1221 provided at upper stream of paper sheet conveyance direction of conveyance route r6, to the alignment member 1224, and aligns the leading edge of paper sheets S by contacting the leading edge of paper sheets S to alignment member 1224.

Next, the folding process, the binding process and the cutting process to trim an end of a booklet of paper sheets S in post processing apparatus B will be concretely explained.

<A Folding Function>

Folding processing unit 1230 is provided in the down stream in the direction of paper sheet conveyance on conveyance alignment belt 1220. Folding processing unit 1230 comprises first folding roller 1231, second folding roller 1232, third folding roller 1233, first folding plate member 1234 and second folding member 1235.

A paper sheet or plural paper sheets S reached folding processing unit 1230 are nipped by first folding roller 1231, second folding roller 1232 rotating reversibly each other and first folding plate member 1234 and whereby crease "1*a*" is formed across the paper sheet width at the center of the paper sheet in the conveyance direction. (Referring to FIG. 12)

After that, first folding roller 1231 and second folding roller 1232 rotate reversibly. Paper sheets S, on which fold "a" is formed are getting back away from the nip position of first folding roller 1231 and second folding roller 1232 and is returned to the original horizontal conveyance route. Paper sheets S are continuously conveyed to conveyance route r7 located in the extended direction of fold "a" (Refer to FIGS. 9 and 10) by conveyance cog 1236A fixed to rotating conveyance belt 1236 (Referring to FIG. 11) and are sent to binding process unit 1240.

As described above, folding processing unit 1230 folds and treats a small number of paper sheet from one to three. It firmly folds the paper sheets to make a crease "a" on the paper sheets and sends them to binding process unit 1240 so that a high quality booklet SA (binding booklet) with less bulkiness of fold "a" can be produced.

<Binding Function>

Paper sheets S folded in folding processing unit 230 is conveyed in the direction of conveyance route r7 by conveyance belt 236 and a guide member sequentially (not shown), and loaded on saddle stool accumulation member 1241 in binding process unit 240. Succeeding center-folded sheets S are continuously loaded on saddle stool accumulation member 1241 through conveyance route r7.

Saddle stool accumulation member 1241 is configured by two-piece of guide plates perpendicular to each other and fixed to main body of post processing apparatus. Adjacent to the top portion of saddle stool accumulation member 1241, pressing member 1241A, which can be moved up and down, having an accompanying force by a coil-spring, is supported by staple receiving mechanism 1244.

Pressing member 1241A is formed in convex shape and folded portion "a" of center-folded sheets S is loaded on the top of pressing member 1241 along the ridgeline. (Refer to FIG. 9)

A position of plural paper sheets S loaded on saddle stool accumulation member 1241 and width alignment member 1242 are adjusted in the width direction by pressing member 1241A.

Stapling mechanism 1243 is fixed above pressing member 1241A. Pressing member 1241A and staple receiving mechanism 1244 are provided in saddle stool accumulation member 1241 so that they can move up and down.

Two sets of binding member comprising a two-divided structure, stapling mechanism 1243 and staple receiving mechanism 1244, is provided along the folded direction. When the operation unit specifies a binding process, staple-receiving mechanism 1244 moves up to start binding process. Namely, Staple SP is driven into two central distributions along the fold "a" of booklet SA on pressing member 1241A by two sets of binding member. Booklet SA, which has been folded and bound, is shown in a perspective view in FIG. 10.

<Booklet Cutting Function>

Booklet SA being bound by binding process unit 240 is supported, swung and placed onto conveyance belt 1252 by guiding member 1251 in a direction shown in a dashed line. Booklet SA is conveyed in the slanting down direction by rotating conveyance belt 1252, and further conveyed while being maintained in a slant posture to the predetermined-position by rotating conveyance belt 1253 and paused.

After that, conveyance belt 1253 swings to be in the horizontal position. Cutting device (a trimmer) 280 cuts the free end of booklet SA, which is on conveyance belt 1253 in the horizontal direction, (an open edge opposite of the folded edge), since the free end of booklet SA is irregular due to the number of pages of booklet SA.

Booklet SA being bound, to which cutting process has been applied, is loaded on conveyance belt 253, which is rotating reversibly, and is dropped from the edge portion of conveyance belt 1253 in the direction shown in arrow by pushing member 1254 (movable alignment member), which pushes the edge of booklet SA. Dropped booklet SA is ejected from an eject tray provided on the outside of front side surface Bf of post processing apparatus B by rotating conveyance belt 1255.

<Cutting Process>

Next, cutting apparatus 1280 and a booklet conveyance member will be explained.

<Booklet Conveyance Driving Means>

Figure 14:
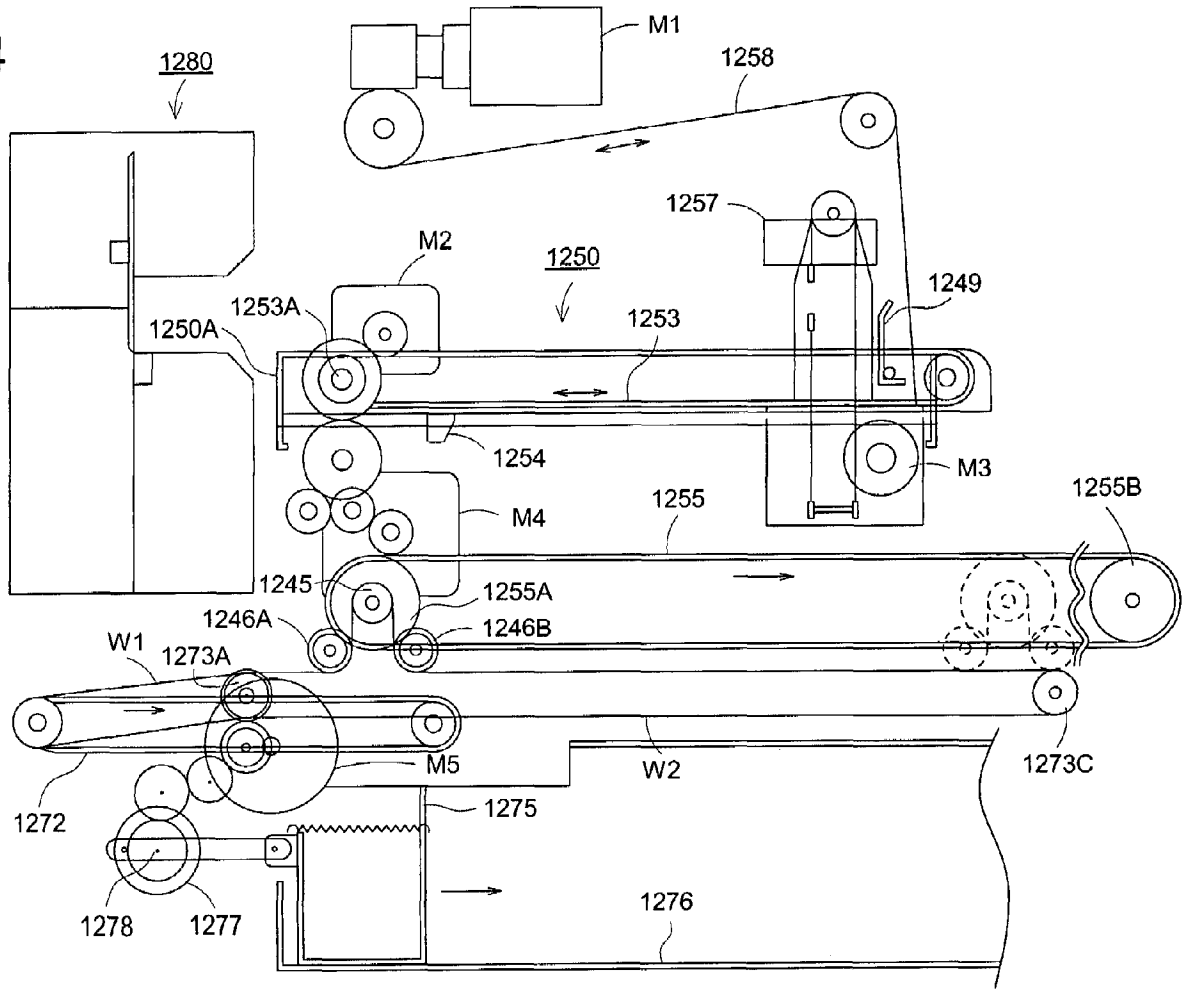
FIG. 14 is an overall view of a booklet conveyance mechanism.

FIG. 14 is an overall configuration of a booklet conveyance driving mechanism.

Motor M1 swings and moves up and down conveyance belt 253 on driving roller shaft 1253A. Motor M2 rotates forward and backward conveyance belt 1253 integrated with pushing member 1254. Motor M3 moves up and down pressing plate 1257, which presses the adjacent folded portion of booklet SA. Motor M4 shifts moving device 1261 straight in a booklet conveyance direction. (explained in details in FIG. 16) Motor M5 functions to rotate ejection belt 1255, which winds around driving roller 1255A and subordinate roller 1255B, to swing conveyance belt for cutting rubbishes 1272; and to move moving member 1275 of cutting rubbish storage box 1275.

Figure 15:
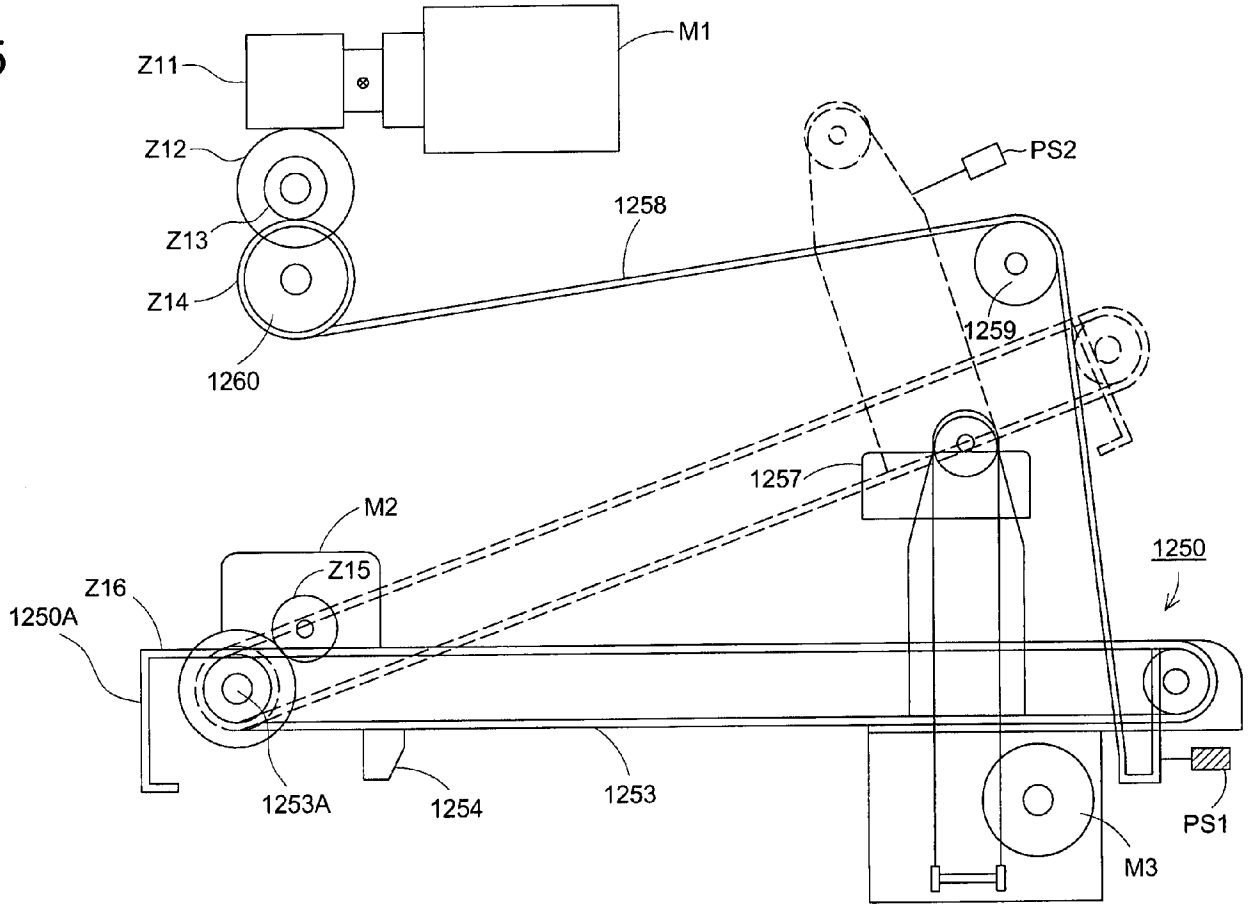
FIG. 15 is a cross-sectional view of a lifting member to swing a booklet-stacking table, and a conveyer belt.

FIG. 15 is a cross sectional veiw of a swinging mechanism to swing booklet conveyance member 1250.

Conveyance belt 1253 of booklet conveyance member 1250 is supported so that it can be rotated on driving roller shaft 1253A. Wire 1258 whose one end is held on the edge of booklet conveyance member 1250 (right side of FIG. 15), is curved along outer circumference of middle roller 1259 supported to the main body of apparatus so that it can rotate freely. And it winds around circumference of pulley 1260. The other end of wire 1258 is fixed on pulley 1260 and stretched.

Gear Z14 fix on rotational shaft of pulley 1260 is connected with gear Z11 fixed to driving-shaft of motor M1 via middle gear Z13 and Z12.

As motor M1 rotes, pulley 1260 is rotated, wire 1258 is wound up and booklet conveyance member 1250 comprising booklet loading table 1250A, conveyance belt 1253, etc. is moved up so that booklet conveyance member 1250 is swung up centering on driving roller rotational shaft 1253A. (Referring to FIG. 15) Dashed line shows the position when booklet conveyance member 1250 is lifted up. PS1 is a sensor to detect the lower position of booklet conveyance member 1250 and PS2 is a sensor to detect the upper position of booklet conveyance member 1250.

When lowering booklet conveyance member 1250 in the horizontal position, as motor M1 rotates reversibly, pulley 1260 is rotated reversibly, tension of wire 1258 is released and booklet conveyance member is lowered by own weight.

Motor M2 rotates driving roller rotational shaft 1253A via gear Z15 and Z16 so that conveyance belt 1253 rotates forward and backward direction.

<Driving Means for Moving Pressing-plate Up/down>

Figure 16:
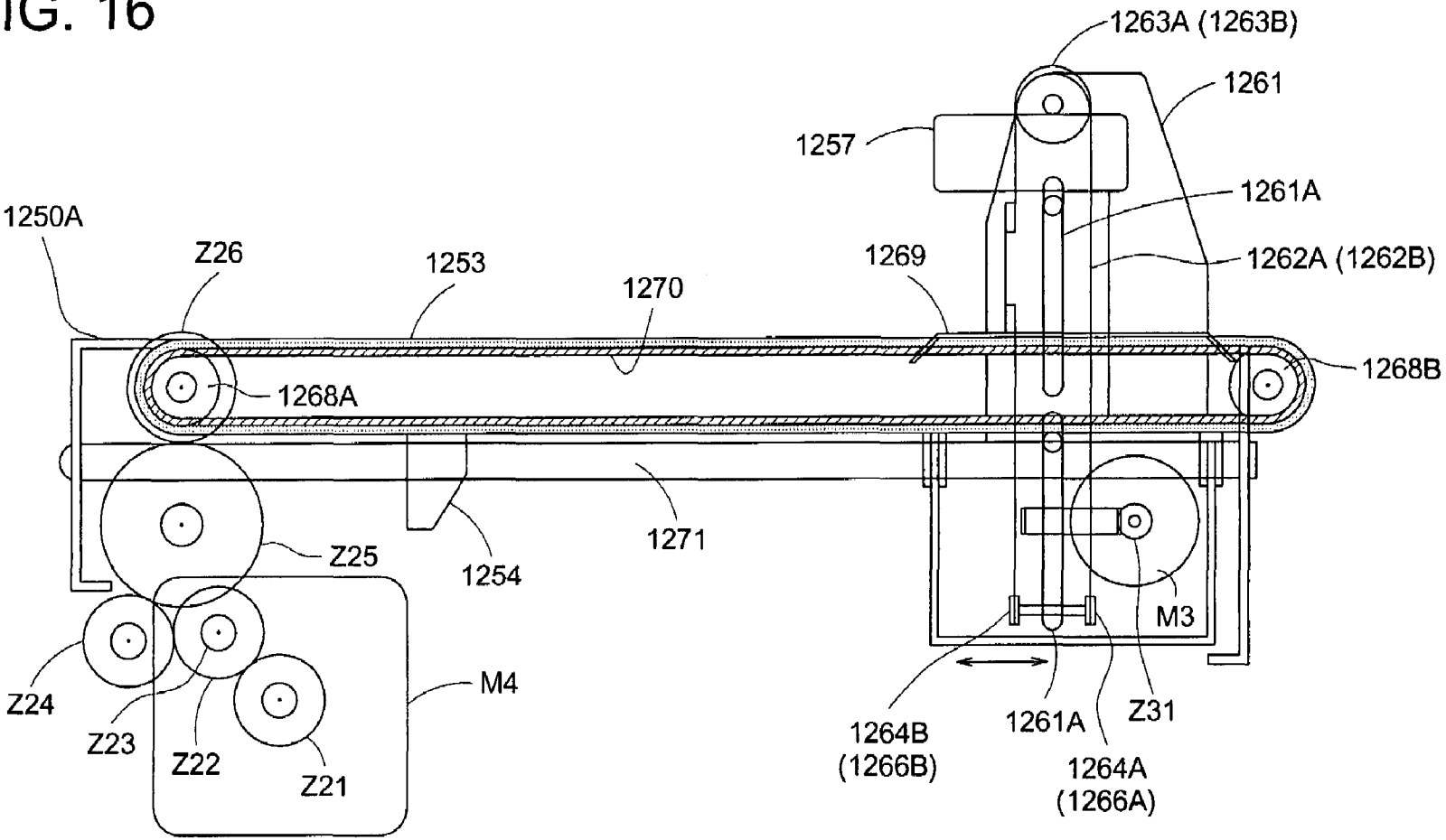
FIG. 16 is a cross-sectional view showing lifting member for a pressing plate and a means for a booklet-conveyance actuating mechanism on a moving device, which supports the pressing plate.

FIG. 16 is a cross sectional view of driving means for moving pressing plate 1257 up/down, and booklet conveyance direction member to move moving device 1261, which supports pressing plate 1257, in booklet conveyance direction.

Booklet conveyance direction moving member includes booklet supporting plate 1269 fixed to moving device 1261, pressing plate 1257 being moved up/down, moving device driving means and driving means for moving up/down pressing plate.

Motor M3 moves up/down pressing-plate 1257, which presses adjacent folded portion of booklet SA. Pressing plate 1257 is supported so that it can move along the longitudinal direction of slot 1261A provided in moving device 1261.

Figure 17:
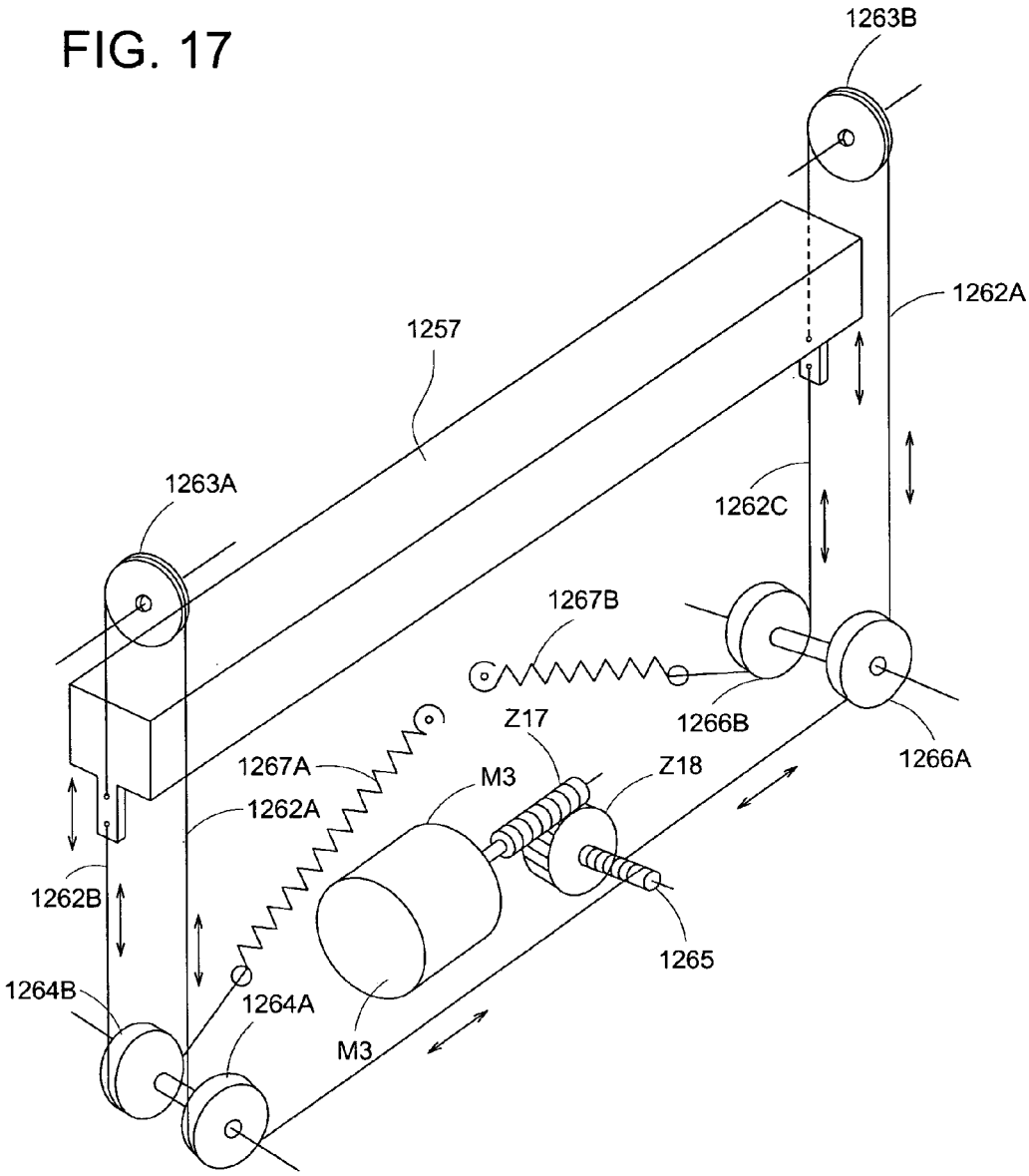
FIG. 17 is a perspective view of a means for activating a lifter to move the pressing plate up and down.

FIG. 17 is a perspective view of driving means, which moves up/down pressing plate 1257.

First wire 1261A whose one end is held on pressing plate 1257 winds around pulley 1263A; further winds around pulley 1265 with plural turns; and winds around pulley 1266A and pulley 1263B. Then, Another end of first wire 1261A is fixed on pressing plate 1257 and tensed.

Second wire 1262B whose one end is held on pressing plate 1257 is connected to one end of spring 1267A with another end of second wire 1262B after winding around pulley 1264B. Another end of spring 1267A is held on the main body of the apparatus.

Third wire 1262C whose one end is held on pressing plate 1257 is connected to one end of spring 1267B with another end of third wire 1262*c* after winding around pulley 1266B. Another end of spring 1267A is held on the main body of the apparatus.

Motor M3 rotates forward; pulley 1265 rotates forward via gear Z 17 and Z 18; wire 1262A is wound up and pressing plate 1257 is lifted up through pulley 1263A and 1263B.

Motor M3 rotates reversibly; pulley 1265 rotates reversibly; wire 1262A moves reversibly; and pressing plate 1257 is moved down via pulley 1263A and 1236B. Pressing plate 1257 is pulled down by wire 1262B, which is pulled by spring 1267A. Simultaneously, pressing plate 1257 is pulled down by wire 1262C, which is pulled by spring 1267B. Adjacent folded potion of booklet SA loaded on booklet loading table 250 is pressed.

<Driving Means in the Booklet Conveyance Direction for Driving Pressing plate>

Motor M4 moves pressing plate 1257 straight in the booklet conveyance direction, which is shown in FIG. 9. A driving rotational force of Motor M4 rotates driving pulley 1268A via gear Z21, Z22, Z23, Z24, Z25 and Z26. Moving device 1261 is held on belt 1270, which winds around driving pulley 1268A and subordinate pulley 1268B. Moving device 1261 is supported parallel to the booklet conveyance direction by guide bar 1271 provided on booklet loading table 1250A, so that moving device 1261 can slide freely. Belt 1270 rotates and moving device 261 moves back and forth along guide bar 1271 as motor M4 rotates.

<Driving of Reference Alignment Member>

FIG. 18 is a cross-sectional view of driving mechanism of reference alignment member 1249. FIG. 18(*a*) shows standby status of reference alignment member resting under booklet loading table 1250A. FIG. 18(*b*) shows reference alignment member 1249 stands up and the top portion of reference alignment member 1249 is projected above booklet loading table 1250A.

Reference alignment member 1249 is fixed to swinging shaft 1248 provided at the edge of booklet loading table 1250A so as to be swung freely. (Refer to FIG. 14) Reference alignment member 1249, in the initial status, is in standby mode, in which reference alignment member 1248 is resting under booklet loading table 250A. (Refer to FIG. 18(*a*))

Sector-shaped cam 1247 is rotated by motor M6 via gear Z19 and Z20. Cam 1247 rotates in clockwise direction and presses back end 1249A of reference alignment member and whereby it rotates on swinging shaft 1248. Consequently reference alignment member 1249 is rotated in the direction as shown in dashed line and stood up (Refer to FIG. 18(*b*)). Sensor PS3 detects both positions of reference alignment member 1249 in initial status position and in stand up potions.

<Cutting Apparatus>

FIG. 19(*a*) is a front view of cutting apparatus 1280 and FIG. 19(*b*) shows a side cross-sectional view of cutting apparatus 1280.

Figure 20:
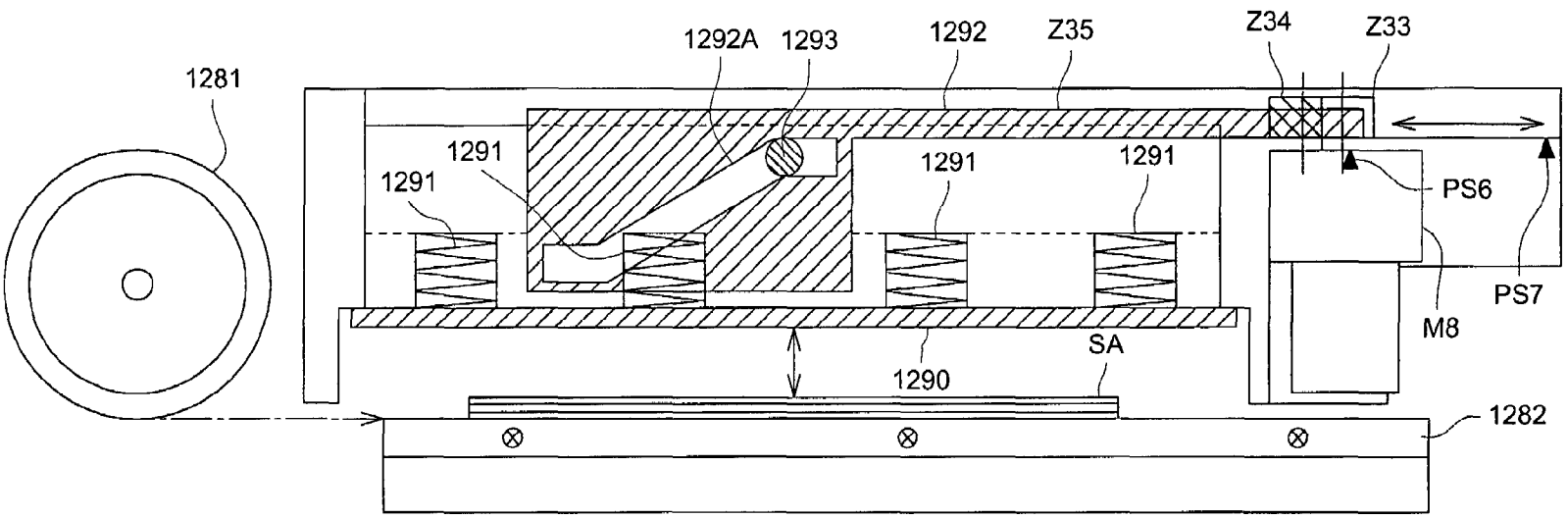
FIG. 20 is a cross-sectional view of a means for actuating a booklet-holding member.

Cutting apparatus 1280 comprises rotating upper blade 1281, which moves straight along width direction, which is perpendicular to the booklet conveyance direction, fixed lower blade 1282 fixed in a booklet width direction, driving means, on which rotes and moves straight rotating blade 1281, and pressing member 1290, which presses adjacent folded-portion of booklet SA (Refer to FIG. 20).

Motor M7 rotates ball screw 1284 provided in the main body of cutting apparatus 1286 via timing belt 1283 and move rotating upper blade moving device 1285 having rotating upper blase 1281 on the straight line. Rotating upper blade moving device 1285 moves straight between initial sensor (HP sensor) PS4 and sensor PS5.

Rack-and-pinion gear Z31 is provided parallel to rotation center of ball gear 1284 in the main body of cutting apparatus 1286. Pinion gear Z 32 provided in rotating upper blade moving device 1285 so as to move freely is geared with rack rear Z31 and rotated as rotating upper blade moving device 1285 moves. As rotation of pinion gear Z27 rotes, gear Z27 fixed to driving force transferring shaft 1287, which hold pinion gear Z32, rotates and rotating upper blade 1281 is rotated via gear Z 28, Z29 and Z30. Consequently, motor M7 functions to rotate and moves straight rotating upper blade 1281. Rotating upper blade 281 is pressed by spring 1288 to fixed lower blade 1282.

<Driving Means for Pressing Booklet>

FIG. 20 is a cross sectional view of a driving means for pressing booklet holding member 290.

Booklet holding member 1290 is moved up and down by a cam mechanism to hold adjacent open end of booklet SA and pressed by pressing spring 1291. Thickness differences between booklets SA are absorbed by plural pressing springs 1291.

Motor M8 rotates pinion gear Z34 via gear Z33 and moves moving member 1292 having rack gear Z35 geared with pinion gear Z34 on the straight line. Roller 1293 planted in booklet pressing member 1290, is fit with cam groove 1292A provided on moving device 1292 so that roller 1293 moves freely along cam groove 1292A.

When cam groove 1292A push down roller 1293, moving member 1292 in which roller 1293 is planted presses booklet SA down for a certain moving distance as moving member 1292 moves.

A length in a vertical direction of cam groove 1292A of moving member 1292 limits the up-and-down movement of booklet holding member 1290. Consequently, The up-and-down movement is limited by detecting the straight movement distance of moving member 292 by sensor PS6 and PS7.

<Means for Ejecting Cutting Rubbishes>

Figure 21:
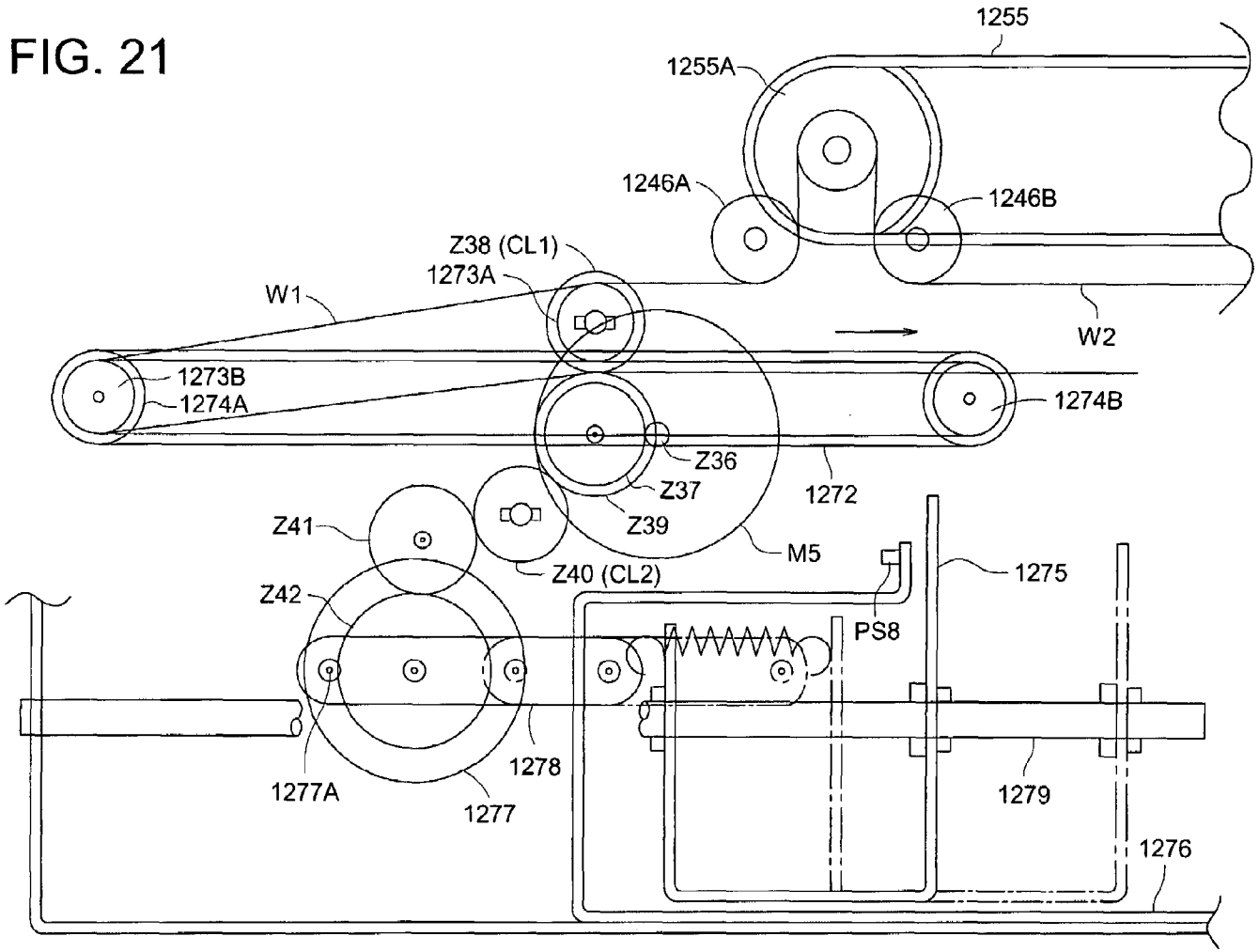
FIG. 21 is a cross-sectional view of a means for ejecting paper trimming waste.
Figure 22:
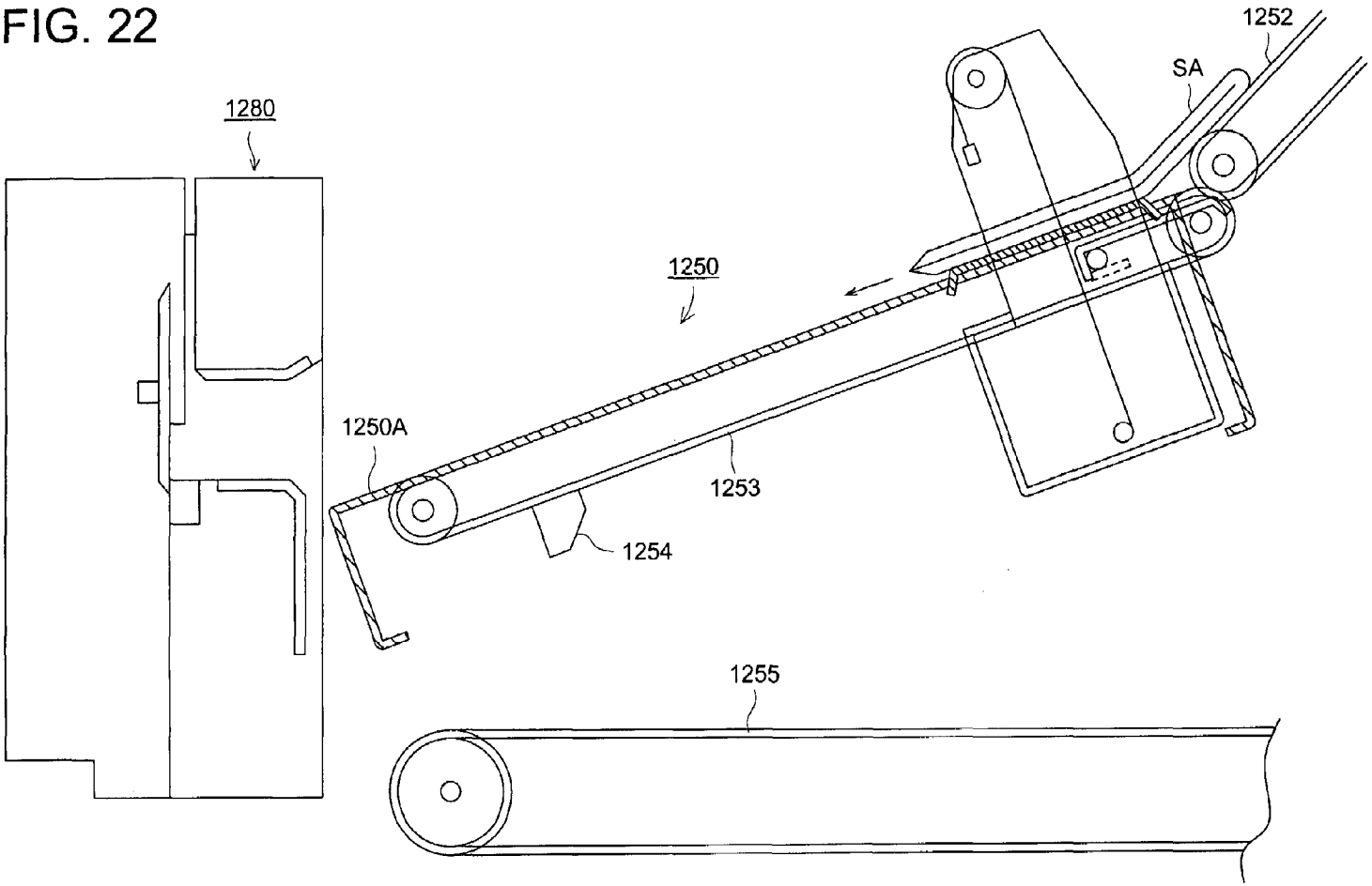
FIG. 22 is a cross-sectional view of a step to convey a booklet after being folded and bound as a booklet to a cutting device.

FIG. 21 is a cross sectional view of an ejection driving member for cutting rubbishes.

Motor M5 as functions to rotates ejecting belt 1255, to rotate cutting rubbish conveyance belt 1272 and to move shifting member 1275 in cutting rubbish storage box 1276.

Motor M5 gears with gear Z38 including an one-way clutch via gear Z36 and Z37. Wire W1 winds around pulley 273A and pulley 273B, which are located on a same shaft and Gear Z 38. Cutting rubbish conveyance belt 1272 winds around pulley 273B and pulley 274A, which are located on a same rotational shaft and another pulley 1247B.

Positive direction rotation of motor M5 rotates cutting rubbish conveyance belt 1272 in a direction shown in arrow via gear Z36–38 and wire W1. Cut-off rubbish being dropped from the free end of the booklet by cutting apparatus 280 is guided by a dropping rubbish guiding plate (not shown), dropped on rotating cutting rubbish conveyance belt 1272, conveyed to cutting rubbish storage box 1276 and stored.

Motor M5 rotates rotating disk 277 via gear Z36, Z37, gear Z40 including an one-way cultch, gear Z41 and Z42. Shaft 1277A provided on a off-center position of rotating disk 1277 is fitted in one end of clank 1278. Another end of clank 1278 is connected with shifting member 1275. Shifting member 1275 is arranged to move back and forth along guide bar 1279.

Rubbishes dropped at the entrance of cutting rubbish storage box 1276 is conveyed by cutting rubbish conveyance belt 1272 and further conveyed to back portion of cutting rubbish storage box 1276 by shifting member 1275, which moves back and forth.

Gear Z38 geared with gear Z39 being driven by M5 has one-way clutch CL1 and gear Z40, which gears with Z39, has one-way clutch CL2.

A selection of the rotational direction of single motor M5 is carried out so that positive direction rotation of motor M5 drives ejecting belt 1255, which ejects booklet after cutting process, cutting rubbish conveyance belt 1272, shifting member 1275 and ejecting belt 1255. And negative direction rotation of motor M5 drives cutting rubbish conveyance belt 1272 and shifting member 1275. Consequently, it is possible to select the ejection of booklet SA or the cutting rubbish conveyance by selecting the appropriate driving control of same driving source (motor M5).

<Ejecting Belt Driving Means>

Pulley 1273A driven and rotated by motor M5 is wound by wire W2 at different position where wire W1 is wound. Wire W2 winds around pulley 1273A, 1273C, paired pulleys 1246A and 1246B and pulley 1245 fixed to driving roller shaft 1255A of ejecting belt 1255.

Motor M5 starts rotating, and then wire W2 rotates and ejecting belt 1255 rotates driven by a rotation of driving roller 1255A.

Pulley 1245, 1246A, 1246B and driving roller 1255A are pulled out in a body as ejecting belt 1255 is pulled out by electrically or manually from the front side Bf of Post processing apparatus B and positioned shown by dotted line in FIG. 14. FIG. 32 will explain the ejection of ejecting belt 1255.

Figure 27:
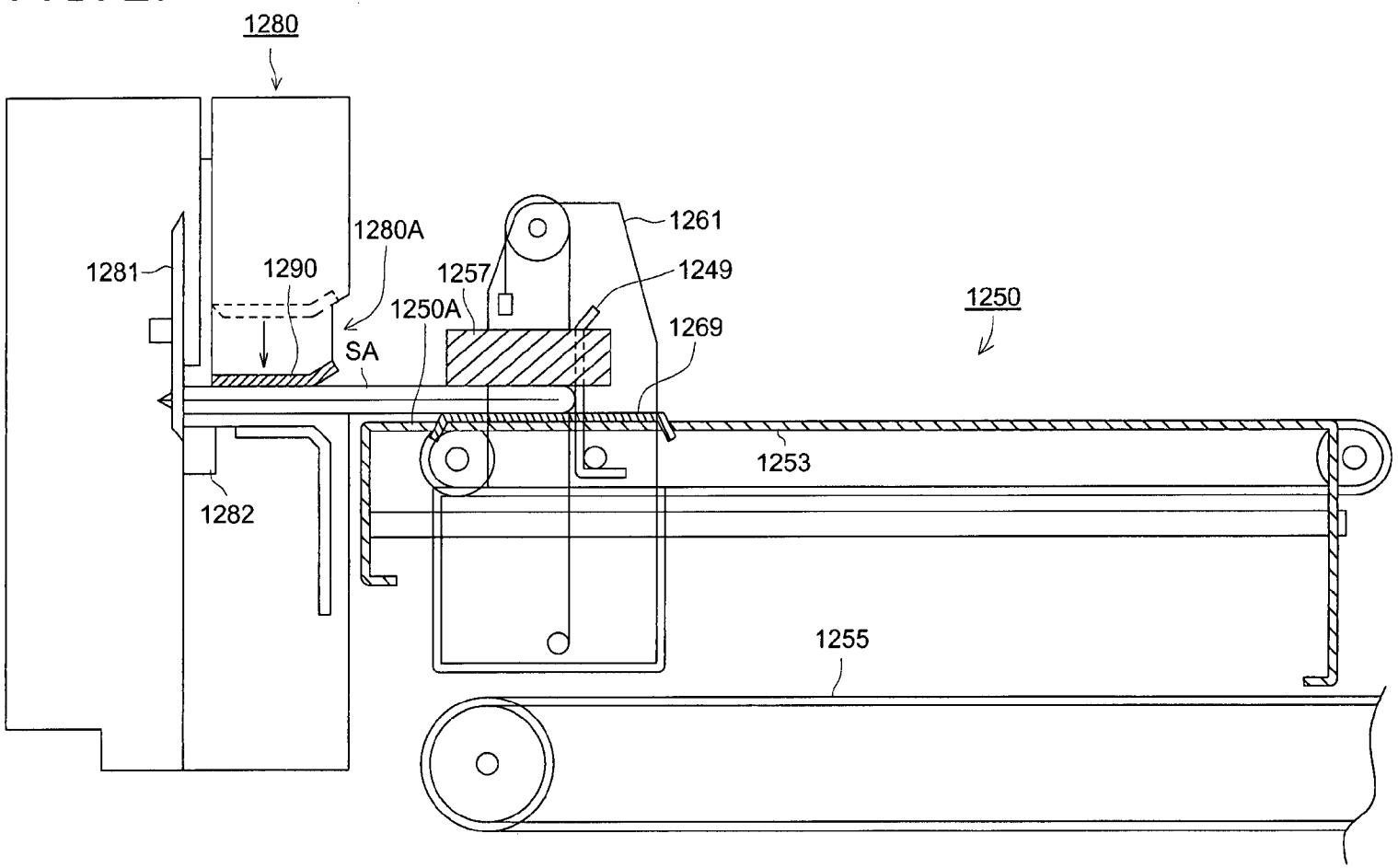
FIG. 27 is a cross-sectional view of a step to cut the edge portion of a booklet in a cutting device.
Figure 28:
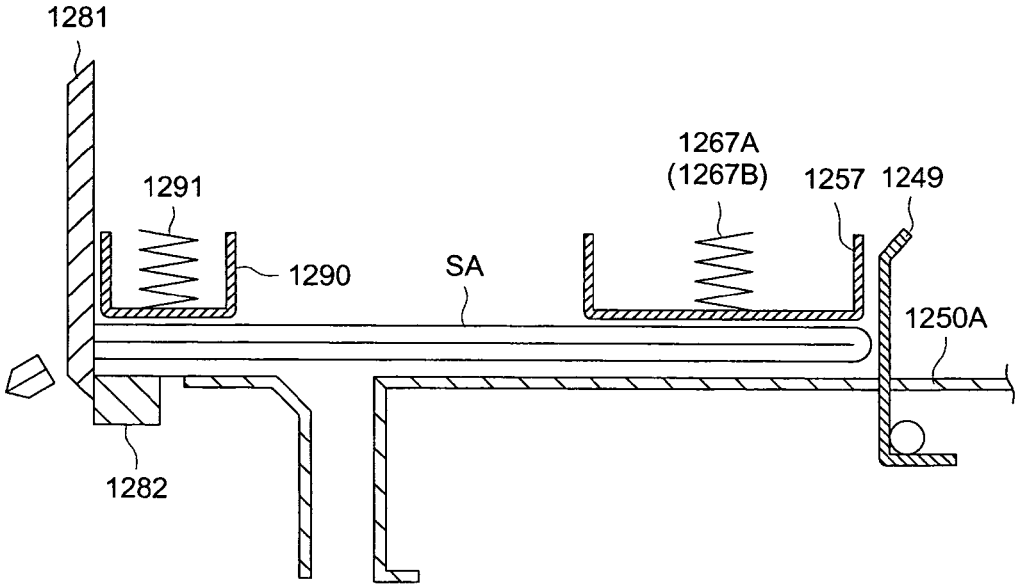
FIG. 28 is anther cross-sectional view of a step to cut the edge portion of a booklet in a cutting device.
Figure 29:
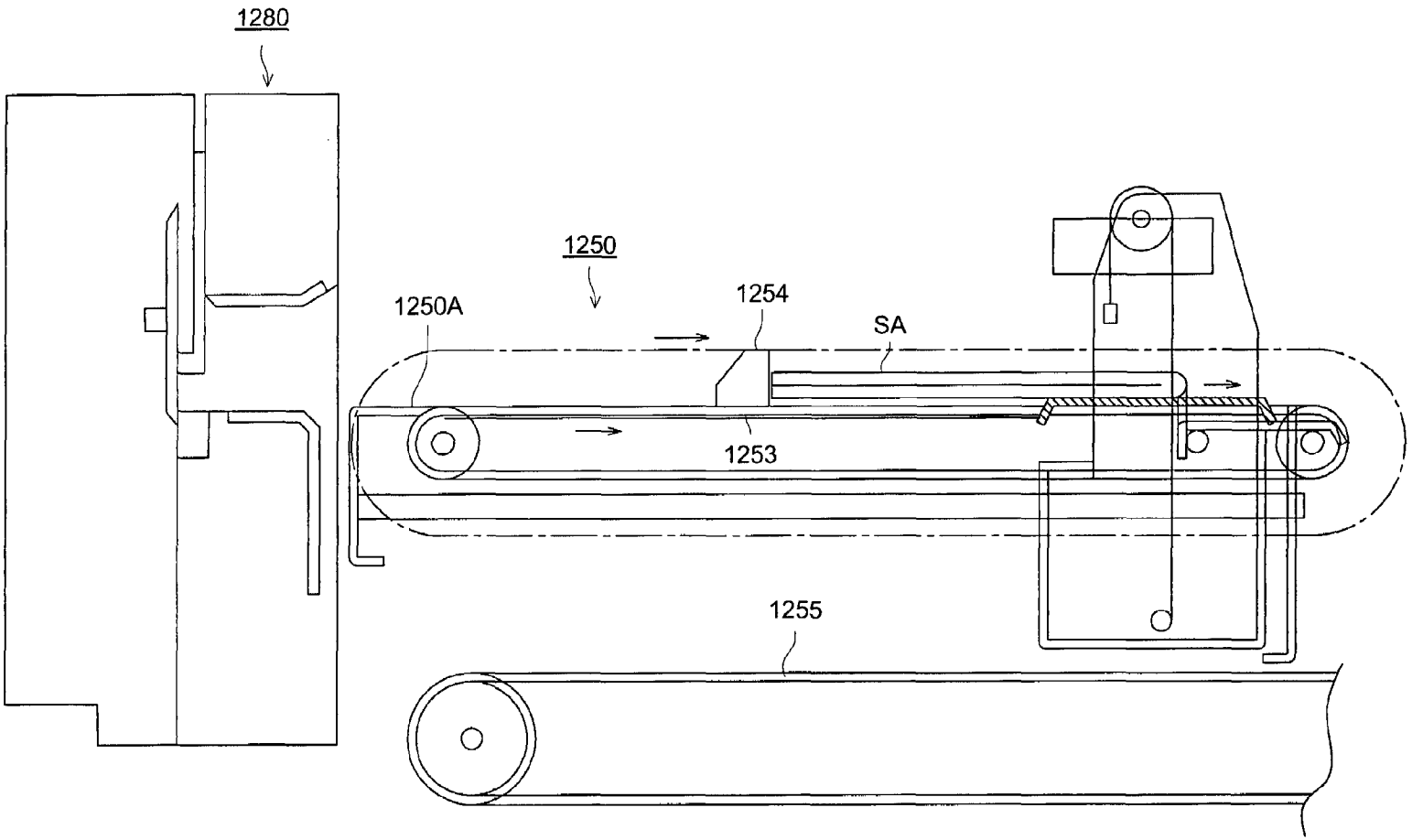
FIG. 29 is a cross-sectional view of a step to eject a booklet to which trimming process has been conducted.
Figure 30:
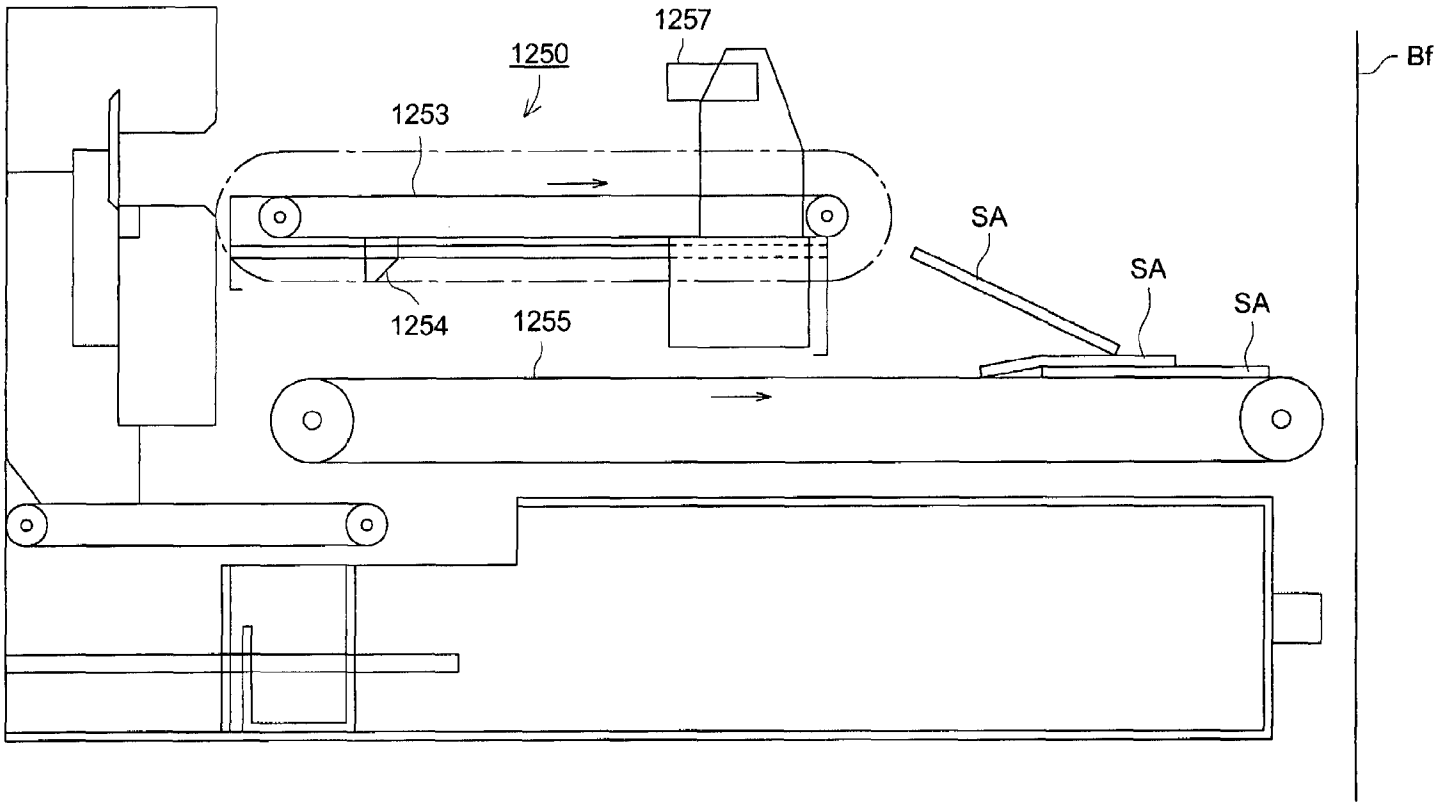
FIG. 30 is another cross-sectional view of a step to eject a booklet to which trimming process has been conducted.

From FIGS. 22–26 are cross-sectional views of series of steps of sending booklet SA, which has been folded, bound and conveyed to cutting apparatus 1280. FIGS. 27–28 are cross sectional views of steps, which trims the free end of booklet SA by cutting apparatus 1280. FIGS. 29–30 are cross sectional views of steps, which ejects booklet SA after cutting process has been applied.

(1) Booklet SA, which slides down on slanted conveyance belt 1252, is conveyed with the lead of free end of booklet SA on booklet loading table 1250A, which is set to the slanted position. (Refer to FIG. 22)

Figure 23:
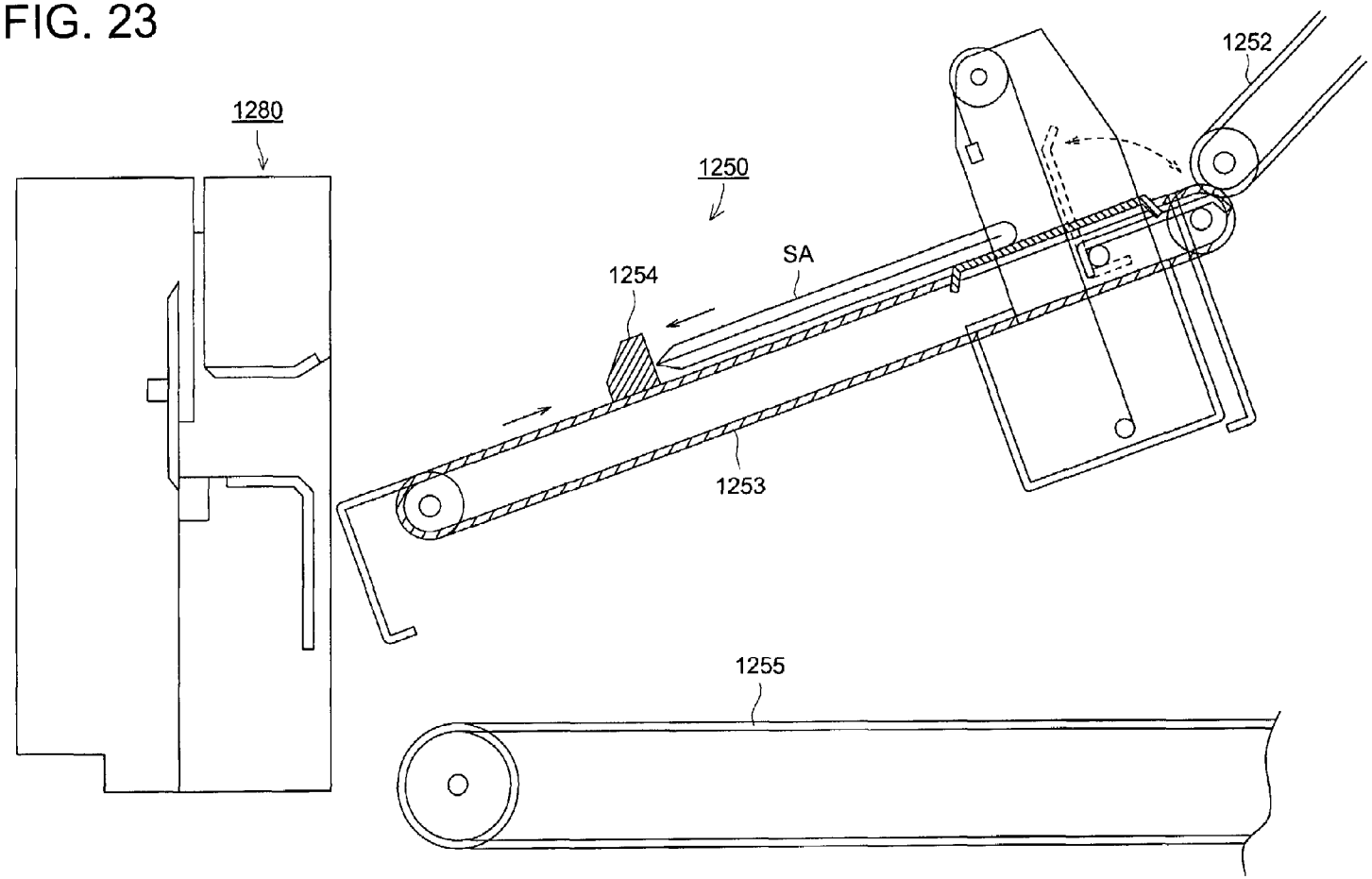
FIG. 23 is a cross-sectional view of a step to convey a booklet to a cutting device.

(2) Conveyance belt 1253 rotates clock wise as shown in FIG. 23, and pushing member 1254 proceeds to a predetermined position corresponding to the paper sheets Size. A leading edge of booklet SA, which slides down on booklet loading table 1250A contacts pushing member 1254 and stops. (Refer to FIG. 23)

Figure 24:
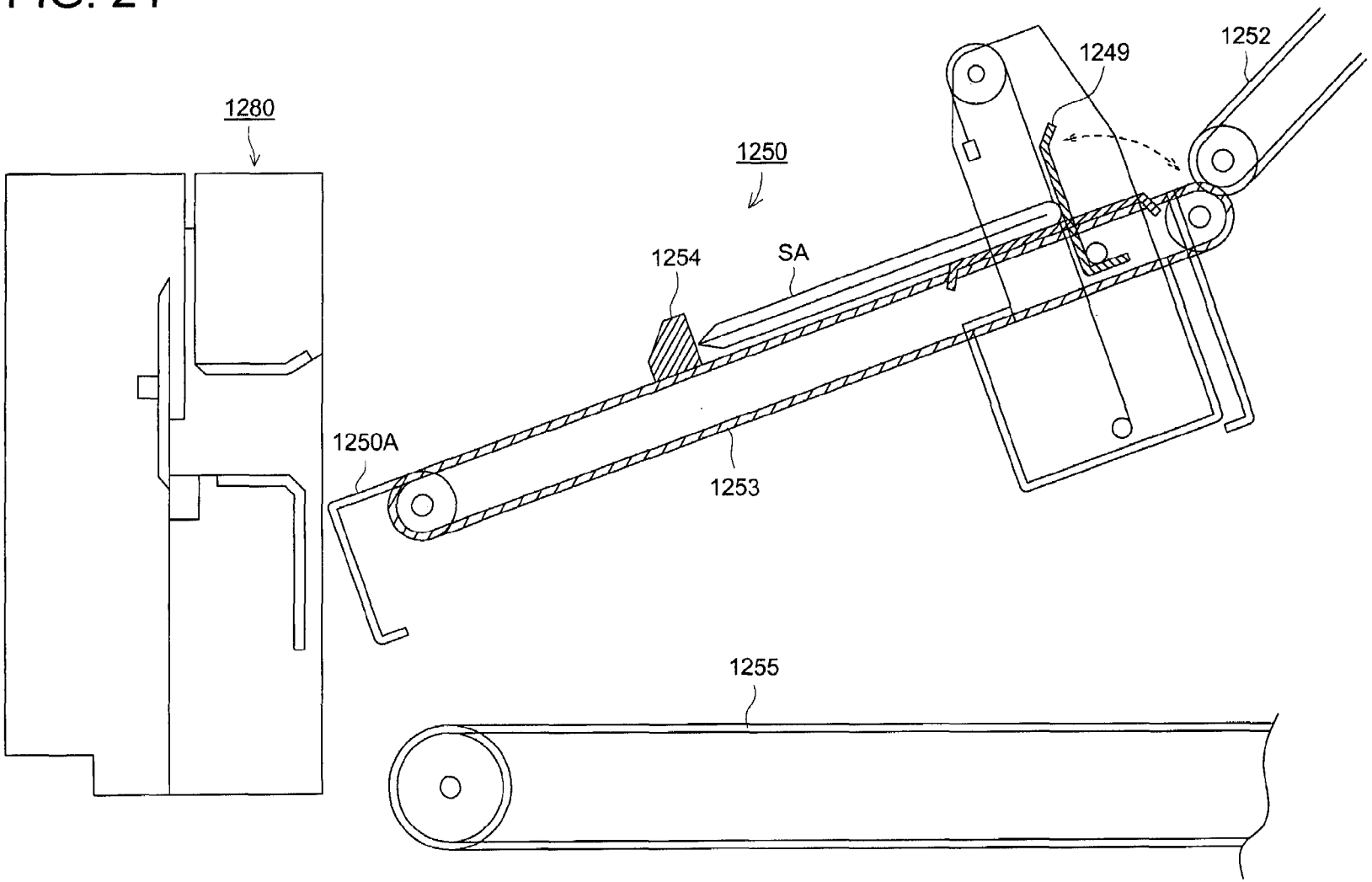
FIG. 24 is another cross-sectional view of a step to convey a booklet to a cutting device.
Figure 25:
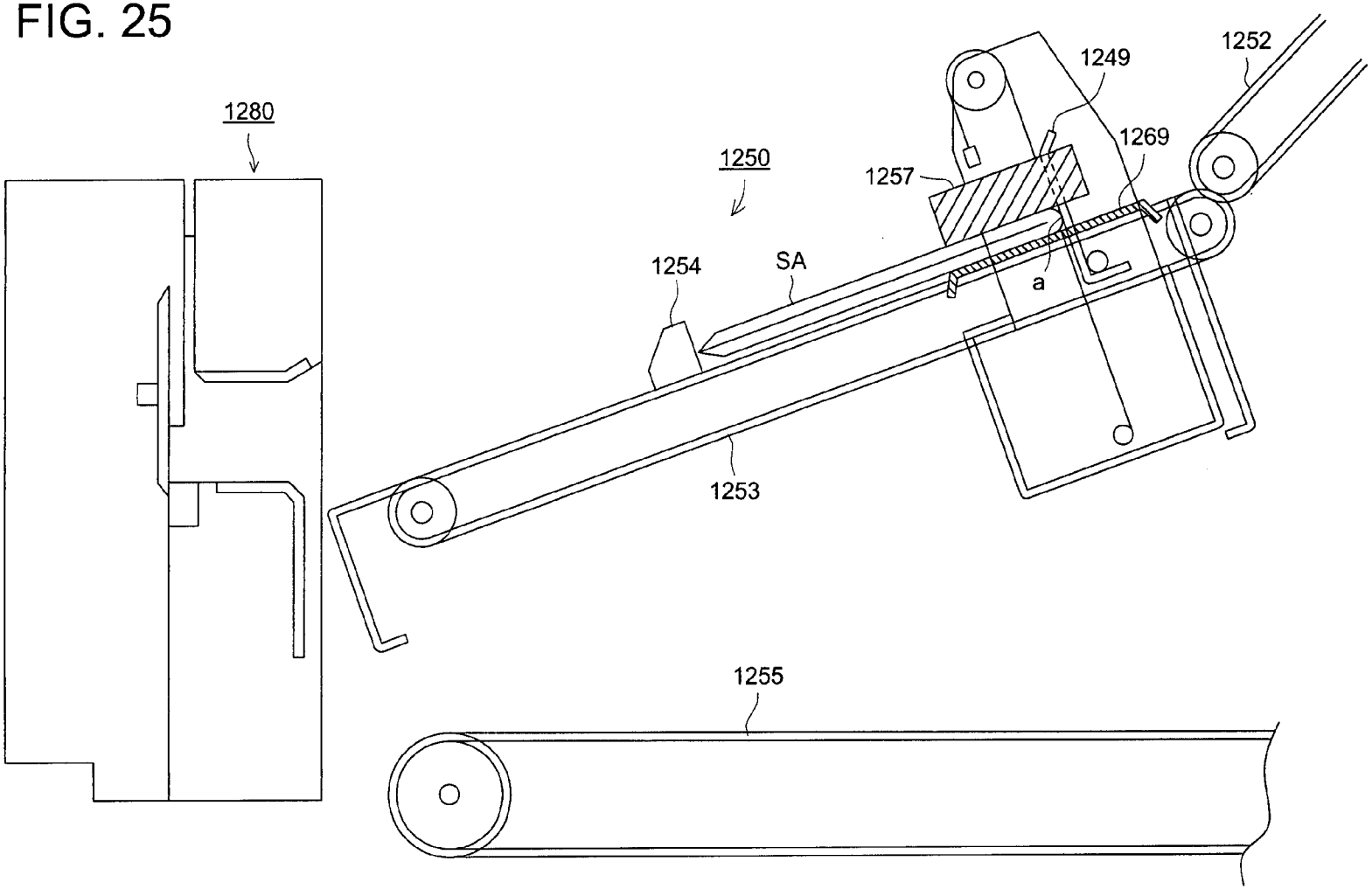
FIG. 25 is yet another cross-sectional view of a step to convey a booklet to a cutting device.
Figure 26:
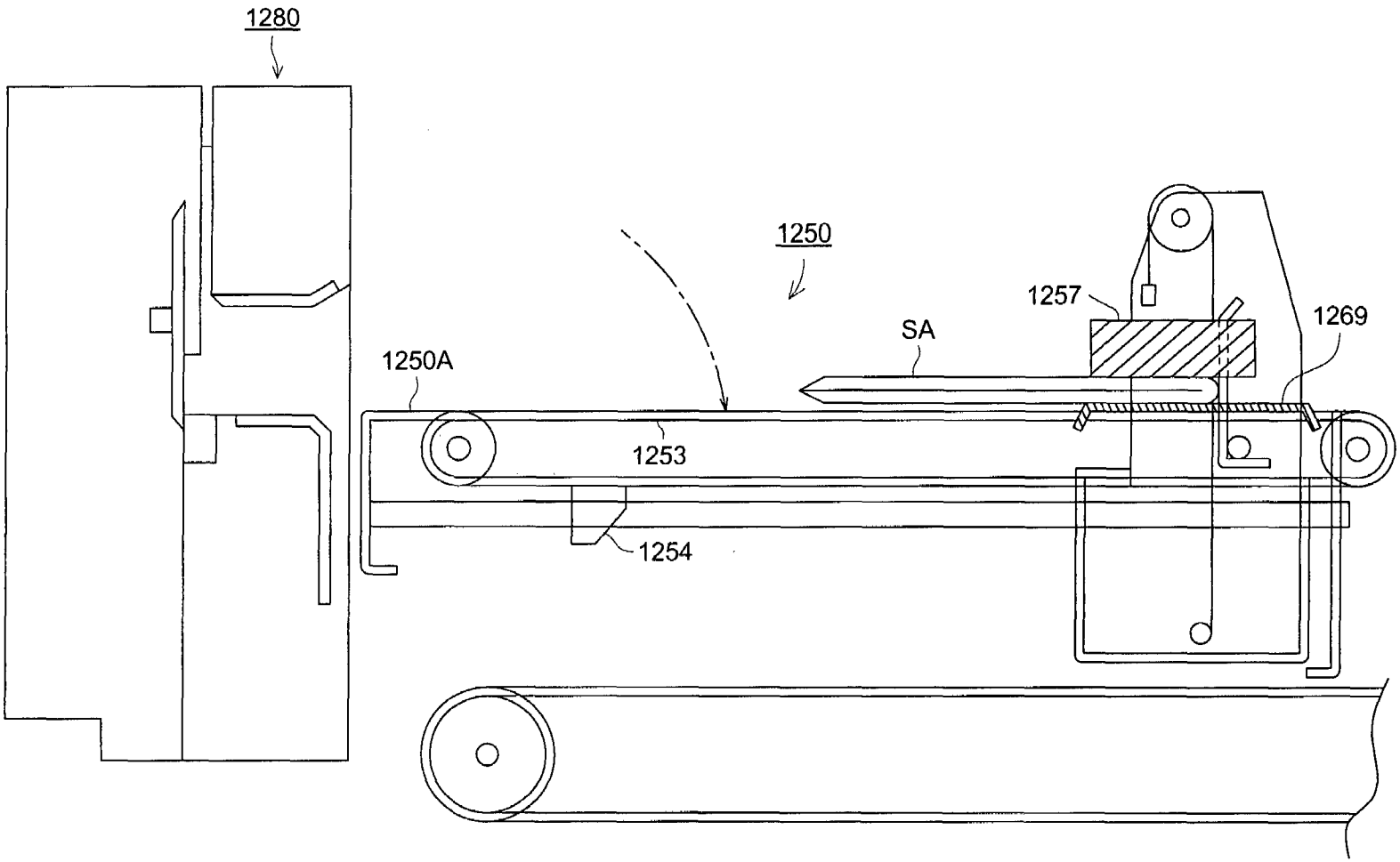
FIG. 26 is one more cross-sectional view of a step to convey a booklet to a cutting device.

(3) A booklet alignment member comprises reference adjustment member 1249, which can stand up and fall down and pushing member 1254, which can rotate. The turn of booklet SA is corrected by pushing leading edge of booklet SA and contact back end of booklet SA to reference alignment member 1249, after which stands up and further pushing member 1254 proceeds as shown in FIG. 24.

(4) A driving means shown in FIG. 15 and FIG. 17 pushes down pressing plate 1257 and the bulky portion adjacent to folded area of booklet SA is flattend by pressing plate 1457. (Refer to FIG. 25) After pressing booklet SA, pressing member 1254 is returned to the initial position by conveyance belt 1253, which rotates reversibly.

(5) Booklet conveyance member 1250A moves from the slanted position to the horizontal position while the pressing member comprising pressing plate 1257 and booklet holding plate 1269, keeps pressing the adjacent portion of folded area "a" of booklet SA. (Refer to FIG. 26)

(6) A driving means shown in FIG. 16 moves a pressing member (pressing unit) having pressing plate 1257 and booklet supporting plate 1269 to the left direction and moves the free end of booklet SA to trimming process opening 1280A of cutting apparatus 1280 while keeping the adjacent portion of folded area "a" between pressing plate 1257 and booklet support plate 1269. (Refer to FIG. 27)

(7) Cutting process is conducted on booklet SA, which has been moved to the cutting position in the cutting apparatus in a flat position, at the condition that booklet SA is pressed by booklet pressing member 1290, which presses the adjacent free end of booklet SA and pressing plate 1257, which presses the adjacent folded area, by cutting the free end of booklet SA by upper blade 1281 and fixed lower blade 1282. (Refer to FIG. 28)

(8) Pressing plate 1257 and booklet pressing member 1290 are released after the cutting process has been carried out. Then, pushing member 1254 pushes the free end of booklet SA by rotating conveyance belt 1253 in a positive direction and moves booklet SA on booklet stacking tablel250A in the ejecting direction.

(9) Booklet SA drops from booklet conveyance member 1250, when pushing member 1254 passes at the winding position and pushing member 1254 pushes the free end of booklet SA. Booklet SA dropped is ejected toward the upper direction on conveyance belt 1255 and loaded on the preceding booklet SA in squamation.

It is possible to open a door on front side Bf of post processing apparatus B to unload a small number of a small-sized booklet SA. (Refer to FIG. 30)

(10) A bulkiness of folded and bound booklet SA depends on a type of paper sheet and the number of paper sheets used, when booklet SA is folded and bounded, in general. It likely occurs that the thickness of booklet SA swells out, when large numbers of paper sheets are used. There is a case that booklet SA cannot be laid in squamation neatly due to the friction resistance between dropped booklet SA and the bulky portion of preceding booklet SA, which has been on ejection belt 1255 via conveyance belt 1253 after the cutting process had been conducted.

Figure 31:
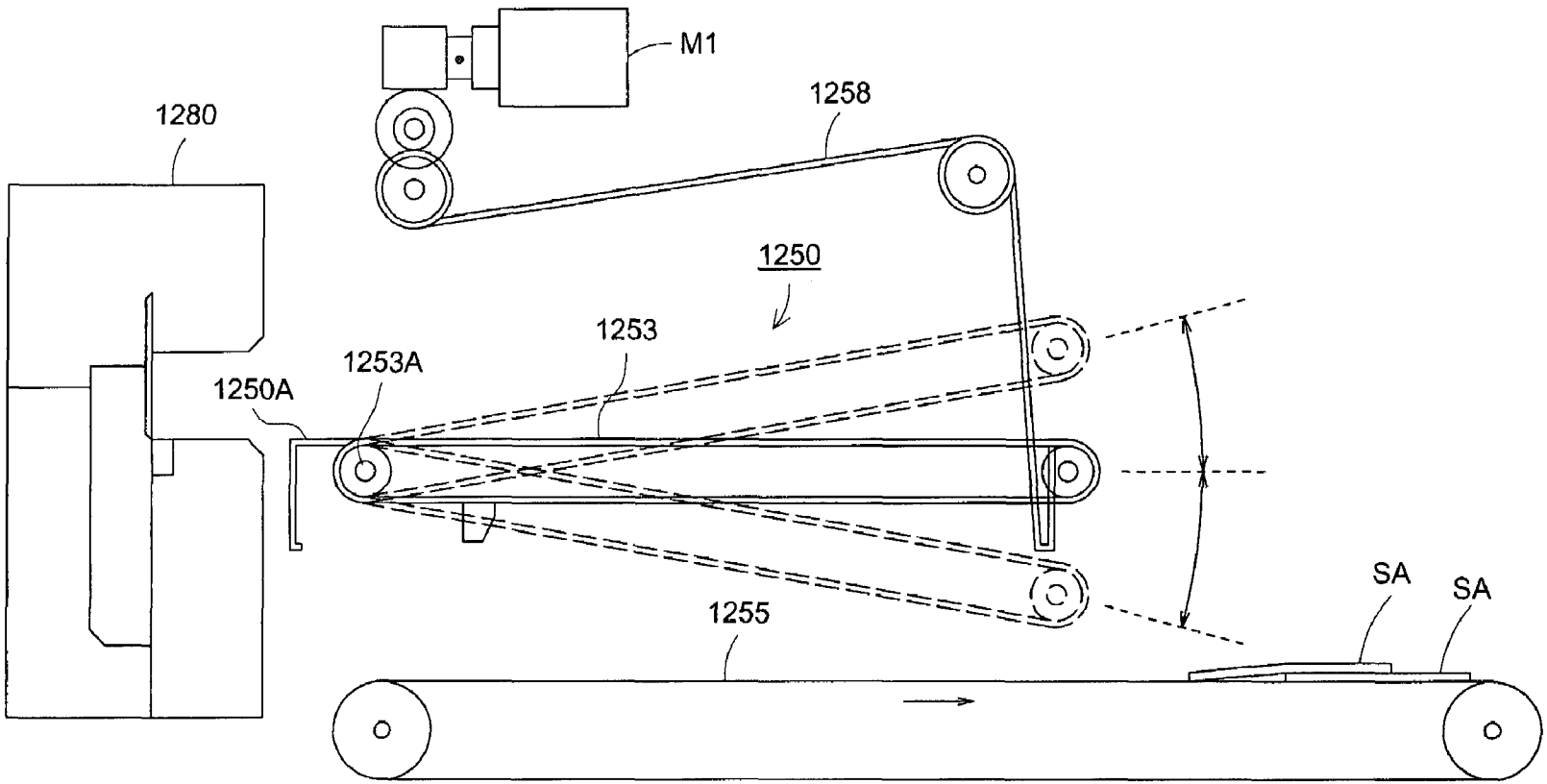
FIG. 31 is an illustration showing that the angle of inclination of a conveyance portion comprising a booklet stacking table and conveyer belt can be variable.

FIG. 31 is a drawing showing a variable slant angel adjustment of booklet conveyance member 1250.

In this case, booklet conveyance member 1250 is moved up by winding up wire 1258 by moving up and down member shown in FIG. 15 so that the ejection side of book conveyance member 1250 is swung up on driving roller rotation shaft 1253A.

Booklet SA conveyed on booklet conveyance member 1250 is ejected a little bit upper direction and placed on ejection belt 1255. Consequently, booklet SA coming later is loaded on preceding booklet in squamation neatly since friction resistance between booklets is getting lower.

When, numbers of paper sheets S are small, right side, which is the ejection side, of booklet conveyance member 1250, is set in lower position centering on driving roller shaft 1253A.

Operation unit 9 together with specifying the type of paper sheet and the number of paper sheets used controls moving up-and-down of booklet conveyance member 1250.

(11) FIG. 32(*a*) is a cross-sectional view showing ejection belt 1255 being stored in post processing apparatus B and FIG. 32(*b*) is a cross-sectional view showing ejection belt 1255 is pulled out in front of front side Bf of post processing B.

Ejection belt 1255 can be pulled out in front of front surface side Bf of post processing B. Namely, A frame (not shown) holding ejecting belt 1255 can be pulled out in the front direction, along slide rails 1295, which are supported by the main body of post processing apparatus, by holding and pulling out a part of the frame (now shown).

Driving roller 1255A, which drives ejecting belt 1255 and pulley 1245 fixed to rotational shaft of driving roller 1255A are moved together by moving the frame. Even driving roller 1255A moves, motor M5 can rotate driving roller 1255A can be rotated, since belt W2, which winds around pulley 1245 can be rotated by motor M5, rotates driving roller 1255A.

Figure 33:
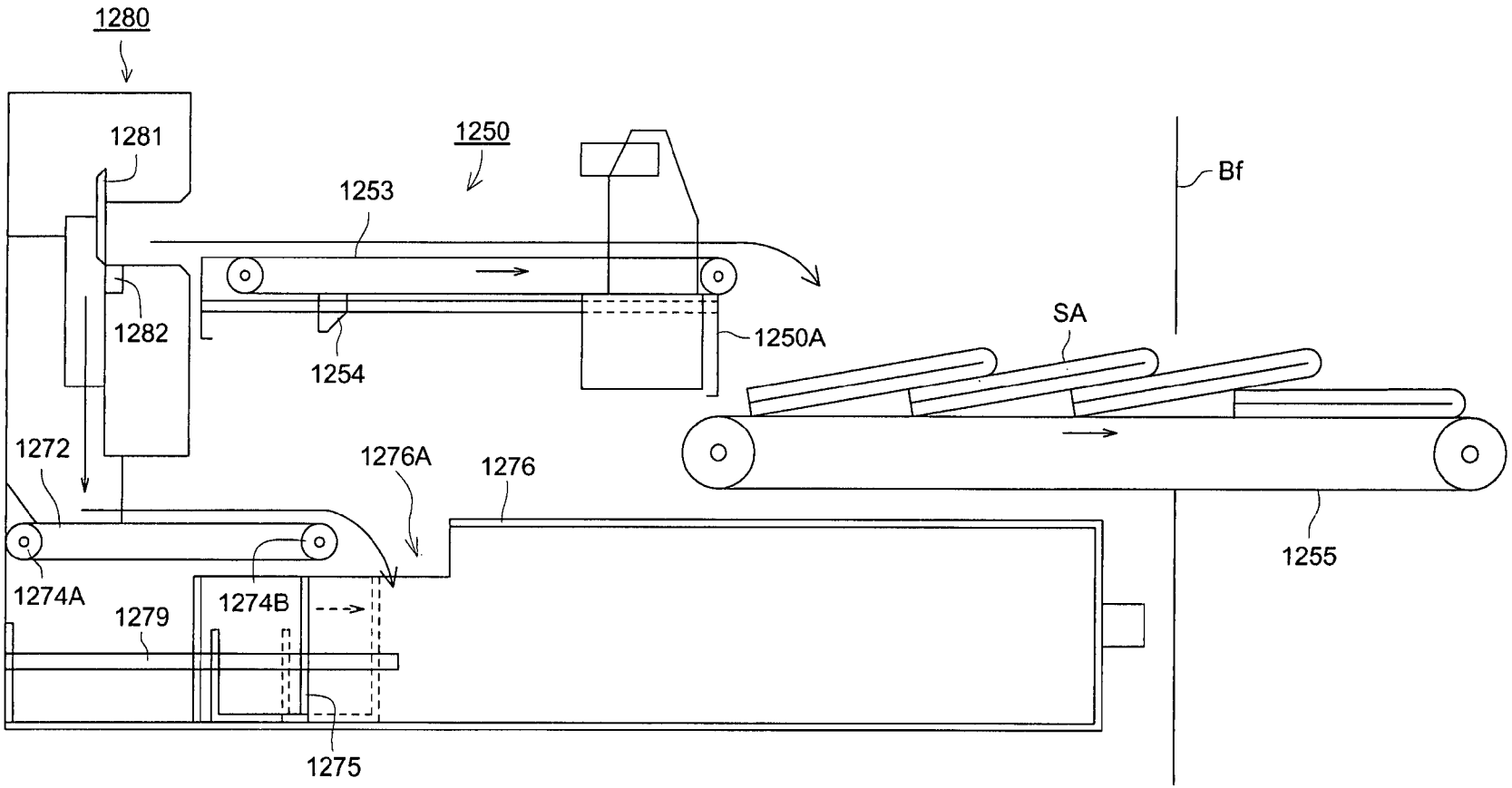
FIG. 33 is a cross sectional view of folded booklets piled on a conveyer belt.

(12) FIG. 33 is a cross-sectional view showing booklets stacked on ejecting belt 1255. Plural Booklets SA dropped from conveyance belt 1253 provided in upper position are placed on ejecting belt 1255 provided at lower position. Rotating ejecting belt 1255 receives booklet SA dropped from conveyance belt 1253 continuously; stacks them in squamation; and ejects them in front of front side Bf of post processing apparatus B. Operator can picks up booklet SA ejected subsequently. Consequently, ejecting belt 1255 is arranged to rotate even though it is pulled out from the front side surface of post processing apparatus B.

(13) As shown in FIG. 33 cutting rubbishes, which is cut by rotating blade 1281 and fixed lower blade 1282 in cutting device 1280 and dropped from the free end of booklet SA, are placed on cutting rubbish conveyance belt 1272 provided at lower portion. Cutting rubbish conveyance belt 1272 is rotated by motor M5 and driving means as shown in FIG. 21. Then the cutting rubbishes are conveyed to the right direction as shown in FIG. 33, ejected and dropped at adjacent pulley 1274B, and sent to opening 1276A of cutting rubbish storage box 1276.

Motor M5 and the driving means shown in FIG. 21, move shifting member 1275 back and forth along guide bar 1279. Cutting rubbish accumulated at adjacent opening 1276 of cutting rubbish storage box 1276 are shifted in right direction as shown in dotted line in FIG. 21, to the depth of cutting rubbish storage box 1276 by conveyance member 1275. When sensor PS 8 detects that cutting rubbish storage box is filled with cutting rubbishes, it issues alarm or stop driving of post processing B. Operator can then change cutting rubbish storage box 1279 to new one or dispose cutting rubbish in cutting rubbish storage box 1276 and re-use cutting rubbish storage box 1276.

In addition, in this embodiment of the present invention, post-processing apparatus connected to an image forming apparatus having folding function and binding function has been explained. However it is possible to apply the present invention selectively to a post processing apparatus having function to bind a booklet first then folding it later, or a bookbinding apparatus connected a small sized printing machine, to realize a multi-purpose and multi-functional post processing as an integrated process.

Also, it is possible to apply the present invention to a post processing apparatus used with small size printing machines, printers, facsimile-machines and integrated machines having multi-functions.

Furthermore, it is possible to use the present invention as a stand-alone type post processing apparatus to perform variable kinds of folding processes independent from an image forming apparatus.

It is possible to unload a bundle of defect free paper sheets by applying the present invention, since confined force affects only paper sheet comprising a bundle of paper sheets by unloading of center-folded sheets by a member, which supports the folded portion of valley side of the paper sheet or adjacent to the folded portion, which are loaded on a loading member by a simple configuration, when the number of paper sheets being loaded reach a predetermined number.

Still further, the supporting member is configured so that a rotating center is provided at a position away from the leading edge portion of a loading member, which supports the paper sheets So that it is possible to smoothly unload a bundle of paper sheets by synchronizing the unloading with the rotation member so as to lift the paper sheets by rotating the supporting member centered on the rotation center.

Also, cost-down can be achieved by that a shape of the supporting member is substantially close to L-shape to be simplify a structure of the supporting member.

It is also possible to surely unload the bundle of paper sheets by moving the supporting member by the driving means reciprocally for a predetermined distance along a creasing direction. Namely, the supporting member can surely support the bundle of paper sheets by moving the supporting member from a stand-by position to the starting position, and the supporting member can surely release the bundle of paper sheets by moving the supporting member from the finishing position to the starting position.

Yet further, a movable supporting member based on the paper sheet size can do a change of paper sheet size speedily. A sure unloading is thereby possible for a variety of paper sheet widths.

And, a stapling process can be achieved by configuring a member for stapling and a means for receiving staples so that multi-function apparatus can be realized.

Even for a bundle of a large number of paper sheets, it is possible to unload a bundle of paper sheets S without defects since the conveyance force from the supporting member is transferred to all paper sheets S through the folded portion of the bundle of paper sheets by moving the supporting member by the driving means from the unloading starting position to the unloading finishing position which supports the folded portion or adjacent to the folded potion of a valley side of a bundle of paper sheets. It is always possible to provide a steady conveyance force and that a folding process and/or a binding process for a small bundle of paper sheets to a bundle of large number of paper sheets since no binding force is used to move the bundle of paper sheets.

Also, in addition, it is possible to correct an excessive conveyance-turn and bulkiness of a booklet being precisely and speedily carried to booklet stacking table and to send booklets to cutting device. Defects such as crinkles occurring to a booklet, and adhesion of foreign matter will be corrected and bookbinding of high quality appearance is possible since no upper and lower conveyer belt to transport the booklet are used.

A reference alignment member is not an obstacle when the booklet is passing by since the reference alignment member is arranged to be ejected or evacuated from a booklet conveyance route of the booklet stacking table by ejecting the reference alignment member when adjusting the booklet and evacuating the reference alignment member when adjusting the booklet when carrying the booklet onto the booklet stacking table and unloading the booklet after trimming process.

Inconveniences such as an occurrence of crinkles and adhesive dirt with paper sheets will be dissolved since a booklet conveyance member is arranged to be a movable endless belt provided under the booklet stacking table, and merely a bumping member is arranged to eject and evacuate from the booklet stacking table so that a pressing force in not applied onto the booklet to be carried onto the booklet stacking table.

A booklet conveyance mechanism can be simplified since the bumping member is designed to be rotatable in ejected position from the booklet conveyance table when conveying the booklet and to be evacuated from the booklet conveyance table when after finishing the conveyance of the booklet and to be integrated with the conveyer belt.

Further, it is possible to operate the bumping member surely and speedily by a simple mechanism, since the bumping member is arranged to have a first motion to receive the leading edge of paper sheets conveyed in the conveyance direction on the booklet stacking table, and a second motion to have the booklet contact the reference alignment member, and the third motion to eject each booklet after the trimming process is finished by the cutting device.

A speedy alignment process corresponding to a paper sheet condition of a booklet can be carried out by moving a bumping member to a predetermined position and being in a stand-by status corresponding to the paper sheet size, thickness of the paper sheets and a number of paper sheets.

It is possible to achieve a high speed productivity of this image forming apparatus since a binding process, an alignment process and a trimming process can be carried out accurately and surely after high speed digital processing, single and double sided image forming and page editing have been carried out.

What is claimed is:

1. A Post-processing apparatus comprising:

a center folding member for making center folded sheets by forming a folded line on paper sheets, on which an image is formed;

a loading member for loading the center folded sheets by supporting a valley side of the center folded sheets;

a supporting member for picking up a folded part or an adjacent folded part of a valley side of the center folded sheets loaded on the loading member;

a driving member for swinging the supporting member; and a conveyer for conveying the center folded sheets, wherein the supporting member swings from a pickup position where the supporting member picks up the center folded sheets on the loading member to a pickup finishing position where the center folded sheets are released and received by the conveyer.

2. The post processing apparatus of claim 1, wherein the supporting member is moved by the driving means, when a number of sheets loaded on the loading-member reaches a predetermined number.

3. The post processing apparatus of claim 1, wherein the driving member moves supporting member from a pickup position, where the supporting member starts supporting the center-folded sheets on the loading member, to a delivery position, where the center-folded sheets are unloaded from the loading member.

4. The post processing apparatus of claim 1, wherein the supporting member has two supporting members, which are provided on both ends in the folded direction of the center-folded sheets loaded on the loading member.

5. The post processing apparatus of claim 4, wherein the supporting member has a rotational center away from a leading edge, which supports the center-folded sheets loaded on the loading member, and the driving member moves the supporting member on the rotational center.

6. The post processing apparatus of claim 1, wherein the supporting member is a bar member comprising a supporting portion and a longitudinal portion, the supporting portion and the longitudinal portion forms a pair of substantially L-shaped bar members, and the supporting portion supports a folded part in the valley side of the center folded sheets loaded on the loading member in substantially parallel to folds of the center-folded sheets loaded on the loading member.

7. The post processing apparatus of claim 6, wherein the supporting member moves in a width direction of the center-folded sheets between a supporting position where the supporting member supports the center-folded sheets, and a remote position away from the both ends of the center-folded sheets.

8. The post processing apparatus of claim 1, wherein the driving member moves the supporting member positioned at a standby position to the pickup position and the supporting member positioned at the delivery position to an evacuated position.

9. The post processing apparatus of claim 1, wherein the supporting member is arranged to move based on a width of a paper loaded on the loading member.

10. The post processing apparatus of claim 1, wherein the loading member includes a means for stabbing staples into the center folded sheets loaded on the loading member along folds of the center folded sheets loaded on the loading member and a means for receiving the staples and the means for receiving the staples is provided below folds of the center folded sheets loaded on the loading member.

11. An image forming apparatus having a post processing apparatus to process paper sheets comprising:

an image forming device to form images on paper sheets;

a center folding member for making center folded sheets by forming a folded line on paper sheets, on which at least one image is formed;

a loading member for loading the center folded sheets by supporting a valley side of the center-folded sheets;

a supporting member for picking up a folded part or an adjacent folded part of a valley side of the center folded sheets loaded on the loading member;

a driving member for swinging the supporting-member; and a conveyer for conveying the center folded sheets;

wherein the supporting member swings from a pickup position where the supporting member picks up the center folded sheets on the loading member to a pickup finishing position where the center folded sheets are released and received by the conveyer.

12. A method for unloading paper sheets comprising:

folding the paper sheets by a center folding member;

stacking the center-folded sheets on a loading member picking up a folded part or an adjacent folded part of a valley side of the center folded sheets loaded on the loading member; and moving the center folded sheets from a pickup position where the supporting member picks up the center folded sheets on the loading member to a pickup finishing position where the center folded sheets are released by swinging the supporting member.

13. A post processing method for image forming paper sheets comprising:

forming a folded line on paper sheets on which images are formed;

supporting a folded part or an adjacent folded part in the valley side of a stacked paper sheets by a supporting member;

binding a booklet by binding the stacked paper sheets supported;

unloading the booklet from the supporting member by moving the supporting member by a driving member;

placing the booklet on a booklet stacking table; and inserting to a cutting device and applying a trimming process.

14. The post processing method of claim 13, comprising:

stopping a leading edge portion in the conveyance direction of the booklet conveyed on the booklet stacking table by a pushing member of a booklet conveyance member;

correcting a curve of the conveyance direction of the booklet by contacting a back edge of the booklet in the conveyance direction to a reference alignment member, which can be set in a stand up position or a laid-down position by moving the pushing member;

pressing the booklet by a pressing member while contacting to the reference alignment member; and inserting to the cutting device and applying a trimming process while maintaining the same posture set when contacting the alignment member.

15. A post processing apparatus to process paper sheets ejected from an image forming apparatus comprising:

a center folding member for making a center folded sheet by folding paper sheets on which images are formed;

a loading member for loading the center folded sheets by supporting a folded part of the valley side of paper sheets folded by the center folding member;

a binding member for forming a booklet by binding the loaded center folded sheets;

a supporting member for picking up a folded part or an adjacent folded part of a valley side of the booklet loaded on the loading member;

a driving-member for swinging the supporting member; and a conveyer for conveying the booklet; and a cutting device to applying a trimming process on the booklet;

wherein the supporting member swings from a pickup position where the supporting member picks up the booklet on the loading member to a pickup finishing position where the booklet is released and received by the conveyer.

16. The post processing apparatus of claim 15, comprising:

a booklet stacking table to put the booklet moved;

a reference alignment member arranged to contact a leading edge of the booklet placed in the conveyance direction on the booklet stacking table;

a booklet alignment member having a pushing member to contact a booklet to the reference alignment member;

a pressing member for pressing adjacent a fold of the booklet placed on the booklet stacking table; and a moving member for moving the pushing member to a sheet conveyance direction; wherein, inserting the booklet into the cutting apparatus with keeping a pressing position by the pushing member and the moving member while contacting the booklet placed on the booklet stacking table to the reference alignment member by the pushing member and applying a trimming process.

17. The post processing apparatus of claim 15, wherein the reference alignment member can be projected or evacuated from a book conveyance path of the booklet stacking table.

18. The post processing apparatus of claim 15, wherein the booklet conveyance member includes a rotatable endless conveyance belt and a pushing member is integrated with the belt.

19. The post processing apparatus of claim 15, wherein a pushing member is arranged to be projected and evacuated from a booklet conveyance path of the booklet stacking table.

20. The post processing apparatus of claim 15, wherein a pushing member has a first function to stop a leading edge of paper sheets conveyed to the booklet stacking table in a conveyance direction, a second function to contact the booklet to the reference alignment member and a third function to eject a booklet, to which a trimming process has been applied by the cutting device.

21. The post processing apparatus of claim 15, wherein a pushing member moves and stands by at a predetermined position based on a paper sheet size, a thickness of a paper sheet and a number of paper sheets.

22. The post processing apparatus of claim 15, being connected with an image forming apparatus to form an image by an image-forming device on paper sheets supplied from a sheet supplying device, wherein the post processing apparatus folds and binds a booklet by applying a center folding process and binding process to ejected paper sheets from the image forming apparatus; and the booklet is conveyed and aligned to be bound as a book after a cutting process including a trimming of a free end of the booklet in the cutting device is applied.

* * * * *